US005970591A

United States Patent [19]

Tanaka et al.

[11] Patent Number: 5,970,591

[45] Date of Patent: Oct. 26, 1999

[54] ELECTRONICALLY CONTROLLED SAMPLE WARPER HAVING YARN EXCHANGE MECHANISM HIGH SPEED WARPING METHOD AND YARN DRAW-BACK DEVICE

[75] Inventors: Yoshihiro Tanaka; Takatsugu Aihara, both of Kiryu, Japan

[73] Assignee: Suzuki Warper Ltd., Kiryu, Japan

[21] Appl. No.: 09/236,337

[22] Filed: Jan. 25, 1999

[30] Foreign Application Priority Data

Apr. 10, 1998 [JP] Japan ..... 10-098975

[51] Int. Cl.[6] ..... D02H 3/00

[52] U.S. Cl. ..... 28/190; 28/184

[58] Field of Search ..... 28/184, 190, 172.1, 28/191, 192, 198, 199

[56] References Cited

U.S. PATENT DOCUMENTS

| | | | |
|---|---|---|---|
| 4,944,077 | 7/1990 | Bollen | 28/199 |
| 4,972,562 | 11/1990 | Tanaka et al. | 28/190 |
| 5,410,786 | 5/1995 | Bogucki-Land | 28/191 |
| 5,630,262 | 5/1997 | Tanaka | 28/190 |

FOREIGN PATENT DOCUMENTS

| | | | |
|---|---|---|---|
| 2062942 | 3/1987 | Japan | 28/184 |
| 2097934 | 5/1987 | Japan | 28/184 |

*Primary Examiner*—Amy B. Vanatta
*Attorney, Agent, or Firm*—Nikaido, Marmelstein, Murray & Oram LLP

[57] ABSTRACT

An electronically controlled sample warper having a yarn exchange mechanism is provided which is capable of extremely reducing yarn looseness possibly occurring during yarn exchange as compared with conventional methods, preventing large variations in yarn tension produced when a yarn is removed to improve the quality of warping and significantly improve the speed of yarn exchange, unlike conventional methods which do produce variations in yarn tension during yarn exchange to cause a degraded quality of warping, and eliminating the need for reducing a warping speed even during yarn exchange to largely reduce a warping time, as compared with the case where a conventional yarn exchange mechanism is used. The electronically controlled sample warper having a yarn exchange mechanism is adapted to automatically exchange yarns and wind the yarns on a warper drum in accordance with a preset yarn order, and comprises one or a plurality of yarn introduction means each rotatably mounted to a side surface of the warper drum for winding a yarn on the warper drum, a plurality of yarn selection guides, arranged in one end portion of a base for supporting the warper drum corresponding to the yarn introduction means, wherein each of the yarn selection guides is pivotally moved to protrude to a yarn exchange position when a yarn is exchanged and pivotally moved to retract to a standby position when a yarn is accommodated, and yarns are passed between the yarn introduction means and the yarn selection guides, and yarn removing guides arranged in one-to-one correspondence to the plurality of yarn selection guides.

23 Claims, 22 Drawing Sheets

ELECTRONICALLY CONTROLLED SAMPLE WARPER HAVING YARN EXCHANGE MECHANISM HIGH SPEED WARPING METHOD AND YARN DRAW-BACK DEVICE

BACKGROUND OF THE INVENTION

1. Field of the Invention

The present invention relates to generally to an electronically controlled sample warper having one or a plurality of yarn introduction means for winding yarns on a warper drum to automatically exchange yarns and wind the yarns on a warper drum in accordance with a preset yarn order, and more particularly to an electronically controlled sample warper which enables efficient exchanging of yarns to be wound, a high speed warping method using the warper, and a yarn draw-back device capable of rapidly solving yarn looseness.

2. Description of the Related Art

As a conventionally used electronically controlled sample warper, there is known a structure disclosed, for example, in Japanese Patent Publication No. 8736/1989, as illustrated in FIGS. 14–18. This known electronically controlled sample warper W has a hollow shaft 1 (FIG. 14). Driving and driven shafts 2, 3 project centrally from opposite ends of the hollow shaft 1. A small gear 5 fixed to a pulley 4 and a pulley 99 are loosely mounted on the driving shaft 2, while a small gear 7, to which a warn introduction means 6 is fixed, is loosely mounted on the driven shaft 3 at the distal end. While the illustrated example shows only one yarn introduction means 6, two or more yarn introduction means 6 must be disposed for a plural-winding system.

The small gears 5, 7 are associated with each other through small gears 9, 10 disposed at opposite ends of an associating shaft 8 extending through the hollow shaft 1, which small gears 9, 10 are meshed with the corresponding small gears 5, 7. The hollow shaft 1 is cantilevered at the driving shaft 2, and a warper drum A is loosely mounted on the hollow shaft 1 on the driven shaft 3 side.

As illustrated in FIG. 15, the warper drum A is formed of drum frames 13, 14 having an outer periphery of like shape having alternately an arcuate portion 11 and a straight portion 12; a pair of rollers 15 disposed one on the arcuate portion 11 of each of the drum frames 13, 14; and horizontal beams 16 carrying the rollers 15 around which conveyor belts 17 (FIG. 14) are wound. The conveyor belts 17 are moved along a plane formed by the horizontal beams 16.

The conveyer belts 17 are simultaneously driven to a common amount of fine movement by a drive member 21 threadedly engaged with interior screw shafts 20 of planetary gears 19 concurrently rotated by meshing with a sun gear 18 suitably driven from the exterior. The distal end of the yarn introduction means 6 is bent inwardly to provide a yarn introducing member 6' which is disposed adjacent to the front end of the outer periphery of the warper drum A. It goes without saying that the movement of the conveyor belts 17 may be carried out by any known driving means other than the above-mentioned structure.

Referring again to FIG. 14, B designates a fixed creel for supporting a plurality of bobbins around which different kinds (different color or different twisting) of yarns 22 are wound; 24, a guide plate for guiding yarns 22 drawn out from the bobbins; 25, a tension regulator for regulating the tension of the yarns 22; 26, a dropper ring; 30, a guide rod for the yarns 22; and E, a yarn fastener having a permanent magnet mounted to a base Y for pressing and setting the yarns.

Further in FIG. 14, reference numeral 27 designates a yarn selection guide unit having a plurality of yarn selection guides 27*a*–27*j* (FIG. 18) for selecting and guiding the yarns 22 according to instructions from a program setting unit 78 (FIG. 17). Reference numeral 28 designates a slitted plate which generates pulses in response to the rotation of the pulley 4 to actuate a plurality of rotary solenoids 29 arranged corresponding to the yarn selection guides 27*a*–27*j*. The yarn selection guides 27*a*–27*j* are mounted to their respective associated rotary solenoids 29 such that they are pivotally moved to advance to an operative position (yarn exchange position) when the rotary solenoids 29 are turned on, and they are pivotally moved in the opposite direction to restore to a standby position (yarn accommodating position) when the rotary solenoids 29 are turned off.

Referring next to FIG. 16, reference numerals 33, 34 and 38 designate shedding bars for jointly forming a shed of the yarns 22, where the bars 33, 38 are upper shedding bars, and the remaining bar 34 is a lower shedding bar. 35 and 37 designate cut shedding bars for separating the shedding down yarns into lower-side yarns and upper-side yarns, where one of the bars 35 is a cut shedding up bar, and the other bar 37 is cut shedding down bar. It should be noted that in FIG. 17, the illustration of the upper shedding bar 38 is omitted.

Reference numeral 39 designates a yarn stopper mounted on the dram frame 13 for stopping a yarn immediately under the broken yarn being shedded (FIG. 15). A rewinder C is composed of a skeleton 40, a pair of rollers 41, 42, a zigzag-shaped comb 43, a roller 44 and a beam 45 for a woven fabric (FIGS. 15 and 16).

Referring again to FIG. 14, reference numeral 46 designates a main motor implemented by an invertor motor for enabling, during operation of the warper, acceleration and deceleration, buffer start/stop, jogging operation and an increased winding speed.

Further in FIG. 14, reference numeral 47 designates a main speed change pulley; 58, a V belt wound on and between the main speed change pulley 47 and an auxiliary speed change pulley 48; 49, a counter pulley which is coaxial with the auxiliary speed change pulley 48; and 50, a brake actuating pinion for reciprocatingly moving a rack to bring the rack into and out of engagement with a brake hole (not shown) in a brake drum D, thus controlling the warper drum A as desired. Reference numeral 57 designates a belt between pulleys 4 on the driving shaft 2; 51, a belt moving motor (AC servo motor); 52, a shift lever; 54 a sprocket-wheel; 55, a chain; 56, a chain wheel for driving the sun gear 18; 57, 58, both V belts; 59, a front cover; 59*a*, a front guide rod; and D, the brake drum.

Reference numerals 67*a*, 67*b* designate sensors for detecting the passing of the slit of the slitted plate 28.

The slitted plate 28 is set to rotate synchronously with the yarn introduction means 6, so that the rotation of the yarn introduction means 6 is also sensed by the sensors 67*a*, 67*b* by detecting the rotation of the slit of the slitted plate 28. These sensors 67*a*, 67*b* actually comprises three sensors which are arranged at an angular space of about 120 (only two of them are illustrated in the figure).

Referring next to FIG. 17, reference numeral 69 designates a movement/stopping change-over lever for the conveyor belts 17; 70, a locking lever for locking the warper drum A; 74, a shedding bar adjusting lever; 75, a shedding bar locking handle; 78, a program setting unit; 79, a controller; 80, a yarn tensioning unit located centrally on the straight part 12 of the warper drum A; and S, a stopper plate disposed on the base Y corresponding to the yarn selection guide unit 27.

The foregoing electronically controlled sample warper, which has been developed by the present applicant, is favorably accepted as being capable of automatic pattern warping through electronic control.

However, since the conventional electronically controlled sample warper as described above employs an ordinary general-purpose motor as a main motor, there are still several problems to solve. First, it is impossible to increase and/or decrease the rotating speed during operation. Miscatching and mischanging inevitably occur during exchange of yarns. Yarns are more susceptible to breakage. In addition, the conventional electronically controlled sample warper is not capable of performing buffer start/stop, jogging operation and so on, so that there have been room for improvement in terms of operation efficiency.

In addition, with respect to a warp density setting method and a mechanism employed thereby, a moving speed of a conveyor belts is determined by changing a gear ratio of a transmission connected to a main motor with a warp density setting dial, and the conveyor belts operate even during idling, so that yarns cannot be regularly wound on a warp drum, causing minute changes in tension and warp length during winding.

The present applicant has also developed and proposed electronically controlled sample warpers which employ an invertor motor and an AC servo motor in order to eliminate the inconveniences mentioned above (Japanese Patent Publication Nos. 64-10609 and 64-10610). The respective electronically controlled sample warper is provided with a fixed creel for supporting a plurality of bobbins around which different kinds of yarns (yarns of different colors or differently twisted yarns).

The present applicant has also developed and proposed an electronically controlled sample warper which is capable of simultaneously warping a plurality of yarns (Japanese Patent Publication No. 4-57776). This electronically controlled sample warper eliminates the need for a yarn exchange process to suppress time loss for yarn exchange to zero. In addition, since a plurality of yarns can be simultaneously wound on a warper drum, a warping operation time can also be reduced.

Since this electronically controlled sample warper capable of simultaneously warping a plurality of yarns is provided with a plurality of yarn introduction means, a conventional fixed creel cannot support it. For this reason, a rotary creel has been developed, together with the development of the electronically controlled sample warper capable of simultaneously warping a plurality of yarns, for simultaneously warping a plurality of yarns. The development of this rotary creel enables a plurality of yarns to be simultaneously warped, consequently realizing a reduction in a warping time.

The present applicant has also proposed an electronically controlled sample warper capable of aligned winding, wherein after a first column of yarns has been wound on a warper drum, the next column of yarns is wound such that the beginning of the yarns of the next column are positioned in front of the yarns of the first column, thereby making it possible to achieve aligned winding warping in order from the lower yarns on the warper drum, and to facilitate winding of yarns to a weaving beam even if a warping length is longer (Japanese Patent Laid-open Publication No. 7-133538).

Likewise, this improved version of the electronically controlled sample warper has been highly favorably accepted.

In the proposed electronically controlled sample warper mentioned above, a yarn exchanging operation is performed as follows.

A yarn 22 drawn out from a bobbin is threaded through a tension regulator 25 on a tension base, a double winding/mischange detecting sensor and a drop ring 26, and is passed on a yarn selection guide unit 27 of the electronically controlled sample warper W.

When a start-up switch is turned on, a yarn selection guide 27*a*–27*j* of the yarn selection guide unit 27 having a number indicated by previously inputted pattern data is operated to wind a yarn 22 around a warper drum A by the rotation of the yarn introduction means 6. After an indicated number of yarns have been warped, the yarn selection guides 27*a*–27*h* having the above-mentioned numbers and a yarn removing unit 32*a* are operated so that the yarns 22 are removed from the yarn introduction means 6 by the yarn removing unit 32 and are accommodated in the associated yarn selection guides 27*a*–27*j*.

Next, in the order of the pattern data, a yarn selection guide 27*a*–27*j* having the next indicated number is operated to supply the yarn introduction means 6 with a yarn 22 to wind the yarn 22 on the warper drum A. After an indicated number of yarns have been warped, the yarn selection guides 27*a*–27*h* having the above-mentioned numbers and a yarn removing unit 32*a* are operated so that the yarns 22 are removed from the yarn introduction means 6 by the yarn removing unit 32 and are accommodated in the associated yarn selection guides 27*a*–27*j*.

In this way, the yarn selection guides 27*a*–27*j* and the yarn removing unit 32*a* are operated in the order of the pattern data to execute yarn exchange to warp a stripe pattern on the warper drum A. The yarn exchanging mechanism will be described in a more specific manner with reference to FIGS. 18–25.

Referring first to FIG. 18, a yarn selection guide unit 27 has a plurality of yarn selection guides 27*a*–27*j* for selectively guiding yarns 22. A rotary solenoid 29 is attached to each of the yarn selection guides 27*a*–27*j*, such that the yarn selection guides 27*a*–27*j* are pivotally moved to advance to an operative position (yarn exchange position) when the rotary solenoids 29 are turned on, and they are pivotally moved in the opposite direction to restore to an original standby position when the rotary solenoids 28 are turned off. The conventional yarn exchanging mechanism uses the yarn introduction means 6 to sequentially exchange yarns and wind the yarns on the warper drum A. A yarn 22 supplied from a fixed creel B passes between a front cover 59 and a stopper plate S, and is held by the yarn introduction means 6 and wound on the warper drum A. As illustrated in FIG. 19 (a yarn selection guide 27*e* is illustrated), the conventional yarn selection guides 27*a*–27*j* are each formed of a straight arm having a distal end portion bent in the same direction as the rotating direction of the yarn introduction means 6.

Next, description will be made on how a yarn 22*a* of a yarn selection guide 27*a*, for example, is exchanged to a yarn 22*e* of the yarn selection guide 27*e* in the yarn exchanging mechanism in the conventional electronically controlled sample warper with reference to FIGS. 20–25. First, a yarn removing unit 32 mounted to the base Y is actuated, and the yarn 22*a* is removed from the yarn introduction means 6 by a yarn removing part 32*a* after the yarn introduction means 6 has passed over the yarn selection guide unit 27 (FIG. 20). The removed yarn 22*a* is guided between the base Y and a stopper plate S by a front guide rod 59*a* protrusively formed on the inner surface of a lower portion of the front cover 59, and pressed to the stopper plate S, so that the yarn 22*a* abuts to a yarn selection guide 27*a* which is advanced to the yarn exchange position (FIG. 21).

As the yarn selection guides 27*a* is pivotally moved toward the base Y and accommodated therein at the standby position, the removed yarn 22*a* is also held by the yarn selection guide 27*a* and accommodated together in the base Y (FIG. 22).

The yarn selection guide 27*e* of the yarn 22*e* to be next wound is pivotally moved from the base Y to the stopper plate S to reach the yarn exchange position (FIG. 23). Then, as the yarn introduction means 6 passes the position of the yarn selection guide 27*e,* the yarn 22*e* is held by the yarn introduction means 6 and wound on the warper drum A (FIG. 24). While the yarn 22*e* is being wound on the warper drum A, the yarn selection guide 27*e* is pivotally moved to the base Y and accommodated in the standby position (FIG. 25). The yarn exchange is carried out through the foregoing operations.

This conventional yarn exchange mechanism, however, requires the yarn removing part 32*a* interposed between the yarn introduction means 6 and the stopper plate S when the yarn 22 is removed from the yarn introduction means 6 to prevent the yarn extending from the fixed creel B to the yarn removing part 32*a* from moving in the rotating direction.

The yarn 22 prevented from moving in the rotating direction by the yarn removing part 32*a* slides on the yarn introduction means 6 and comes off the yarn introduction means 6.

In this event, the yarn 22 removed from the yarn introduction means 6 must be supplied from the fixed creel B until the yarn 22 abuts to the yarn removing part 32*a* and it is removed from the yarn introduction means 6. Also, a yarn path is different when the yarn is being wound around the warper drum A and when the yarn is exchanged, causing the length of yarn required for yarn exchange to be longer. In addition, since the yarn removing part 32*a* is used, certain impact is applied to the yarn when it is removed from the yarn introduction means 6.

In other words, when the yarn is accommodated during the yarn exchange, the action of the yarn removing part 32*a* prevents the yarn 22 caught by the yarn introduction means 6 from advancing. Further, since the yarn 22 is being removed from the yarn introduction means 6, the yarn is physically loosened.

Particularly, when a yarn is to be accommodated in a yarn selection guide far from the yarn removing part 32*a,* for example, in the yarn selection guide 27*j,* yarn looseness amounts to two times or more as compared with that when a yarn is accommodated in the yarn selection guide 27*a*. For removing the yarn looseness and guiding the yarn toward the yarn selection guides 27*a*–27*j,* a dropping force of a drop ring 26 plays an important role. Specifically, as the drop ring 26 is physically heavier, the yarn looseness can be removed faster.

However, as the drop ring 26 is heavier, a dropping distance of the drop ring 26 becomes longer, so that the weight of the tension regulator 25 on the fixed creel B must be increased for reducing the dropping distance of the drop ring 26.

As a result, the yarn is applied with a larger tension, so that yarn breakage is more likely to occur due to excessive tension to the yarn while the yarn is supplied to the yarn introduction means during the yarn exchange, or during warping.

However, when the weight of the drop ring 26 is reduced, and the weight of the tension regulator 25 on the fixed creel B is also reduced to apply a smaller tension to the yarn, a longer time is taken to remove yarn looseness when the yarn is accommodated during the yarn exchange, causing a failed yarn exchange and an increased number of times of a weaver being stopped, consequently leading to a reduced operating efficiency in any case.

For this reason, in the conventional electronically controlled sample warper, the rotational speed of the yarn introduction means or warping speed (yarn speed) is reduced during yarn exchange from a warping speed (yarn speed) assumed when yarns are not exchanged (for example, 800 meters/minute for yarn speed during warping, and 250 meters/minute for yarn speed during yarn exchange), so as to reduce the number of times a weaver must be stopped due to failed yarn exchange, even if a light drop ring 26 is employed.

However, a reduced warping speed during yarn exchange causes a problem in that a warping time becomes correspondingly longer, particularly an excessively long time is required when warping is performed for a cross-striped pattern which involves frequent yarn exchanges. In addition, there is no existent apparatus which can rapidly and efficiently remove or eliminate yarn looseness.

The present inventors have repeatedly investigated an apparatus which could solve the problems mentioned above and allow for fast and reliable yarn exchange as well as an apparatus which can rapidly and efficiently eliminate yarn looseness, and finally reached the present invention.

OBJECT AND SUMMARY OF THE INVENTION

It is a first object of the present invention to provide an electronically controlled sample warper having a yarn exchange mechanism which is capable of extremely reducing yarn looseness possibly occurring during yarn exchange as compared with conventional methods, preventing large variations in yarn tension produced when a yarn is removed to improve the quality of warping and significantly improve the speed of yarn exchange, unlike conventional methods which do produce variations in yarn tension during yarn exchange to cause a degraded quality of warping, and eliminating the need for reducing a warping speed even during yarn exchange to largely reduce a warping time, as compared with the case where a conventional yarn exchange mechanism is used.

It is a second object of the present invention to provide a warping method which is capable of realizing a significant improvement in warping speed, and exchanging yarns with its high warping speed maintained, i.e., without reducing the warping speed to largely reduce a warping time.

It is a third object of the present invention to provide a yarn draw-back device which is capable of rapidly eliminating a yarn looseness possibly occurring during yarn exchange.

To solve the problems mentioned above, the present invention provides an electronically controlled sample warper having a yarn exchange mechanism for automatically exchanging yarns and winding the yarns on a warper drum in accordance with a preset yarn order. The electronically controlled sample warper is characterized by comprising one or a plurality of yarn introduction means each rotatably mounted to a side surface of the warper drum for winding a yarn on the warper drum, a plurality of yarn selection guides, arranged in one end portion of a base for supporting the warper drum corresponding to the yarn introduction means, wherein each of the yarn selection guides is pivotally moved to protrude to a yarn exchange position when a yarn is exchanged and pivotally moved to retract to a standby position when a yarn is accommodated, and yarns are passed between the yarn introduction means and the yarn selection guides, and yarn removing guides arranged in one-to-one correspondence to the plurality of yarn selection guides, wherein when a yarn is removed from the yarn introduction means, the yarn held by the yarn introduction means is caught by one of the yarn removing guides, and the caught yarn is next removed from the yarn introduction means and passed to a corresponding yarn selection guide to minimize yarn looseness produced when it is removed from the yarn introduction means.

Preferably, the yarn removing guides each include an oblique side which is inclined toward the distal end of the yarn introduction means, wherein when a yarn is removed from the yarn introduction means, the yarn held by the yarn introduction means is caught by the yarn removing guide, and thereafter the yarn is slid along the guide oblique side of the yarn removing guide toward the distal end of the yarn introduction means to remove the yarn from the yarn introduction means, thus enabling the yarn to be removed from the yarn introduction means with reduced physical impact to the yarn.

More preferably, each of the yarn removing guide includes a triangular guide portion at the distal end thereof, and one side of the triangular guide portion serves as the guide oblique side on which a yarn is slid.

Guide rods may be provided each for catching a yarn held by the yarn introduction means and guiding the yarn toward a yarn selection guide in corporation with the yarn removing guide. Each of the guide rods is offset toward the outside of the warper drum near the distal end of a corresponding yarn removing guide, and arranged obliquely in a direction opposite to a rotating direction of the yarn introduction means, such that a yarn caught by the yarn removing guide is smoothly and reliably moved to the yarn selection guide. Stated another way, the guide rods serve to help remove a yarn from the yarn introduction means.

When a yarn draw-back device for drawing back a yarn is used when the yarn is removed from the yarn introduction means, yarn looseness is rapidly eliminated, and the yarn is free from variations in tension.

Advantageously, the yarn draw-back device may be constructed to blow compressed air in a direction opposite to a direction in which the yarn is supplied, to draw back the yarn, thereby making it possible to extremely rapidly eliminate yarn loose.

A warping method according to the present invention uses the above-mentioned electronically controlled yarn warper having a yarn exchange mechanism to exchange yarns while a warping yarn speed is maintained, i.e., without reducing the warping yarn speed during yarn exchange.

A yarn draw-back device of the present invention comprises a guide tube having an inner space through which a yarn is threaded, an air blow-in space defined at a distal end portion of the guide tube, and an air introduction means having an air introduction port communicating with the air blow-in space and for blowing off air into the inner space through the blow-in space in a direction opposite to an advancing direction of the yarn, wherein compressed air is introduced from the air introduction port to provide the yarn with a draw-back force in a direction opposite to a supply direction of the yarn so that the yarn can be rapidly drawn back. The yarn draw-back device may also be applied to conventional electronically controlled sample warpers as well as to a variety of apparatus which require the elimination of yarn loose, in addition to suitably used in the above-mentioned electronically controlled sample warper having a yarn exchange mechanism.

DESCRIPTION OF THE PREFERRED EMBODIMENTS

Figure 1:
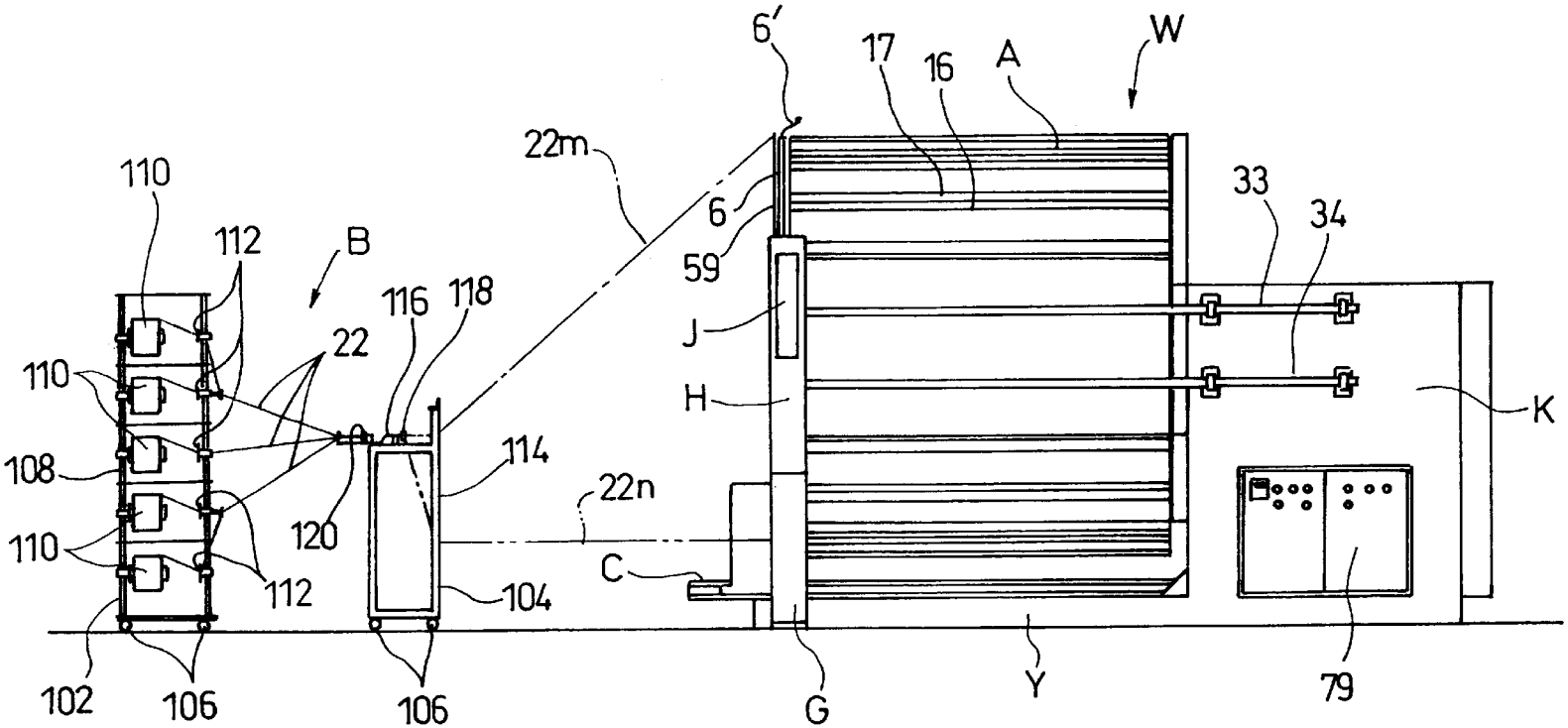
FIG. 1 is a schematic lateral view of an electronically controlled sample warper according to the present invention.

The present invention will hereinafter be described in connection with several embodiments with reference to FIGS. 1–13 of the accompanying drawings, where members identical or similar to those in the prior art apparatus illustrated in FIGS. 14–25 may be explained using the same reference numerals. In addition, for a basic structure of the electronically controlled sample warper, FIGS. 14–17 may be referenced.

Figure 2:
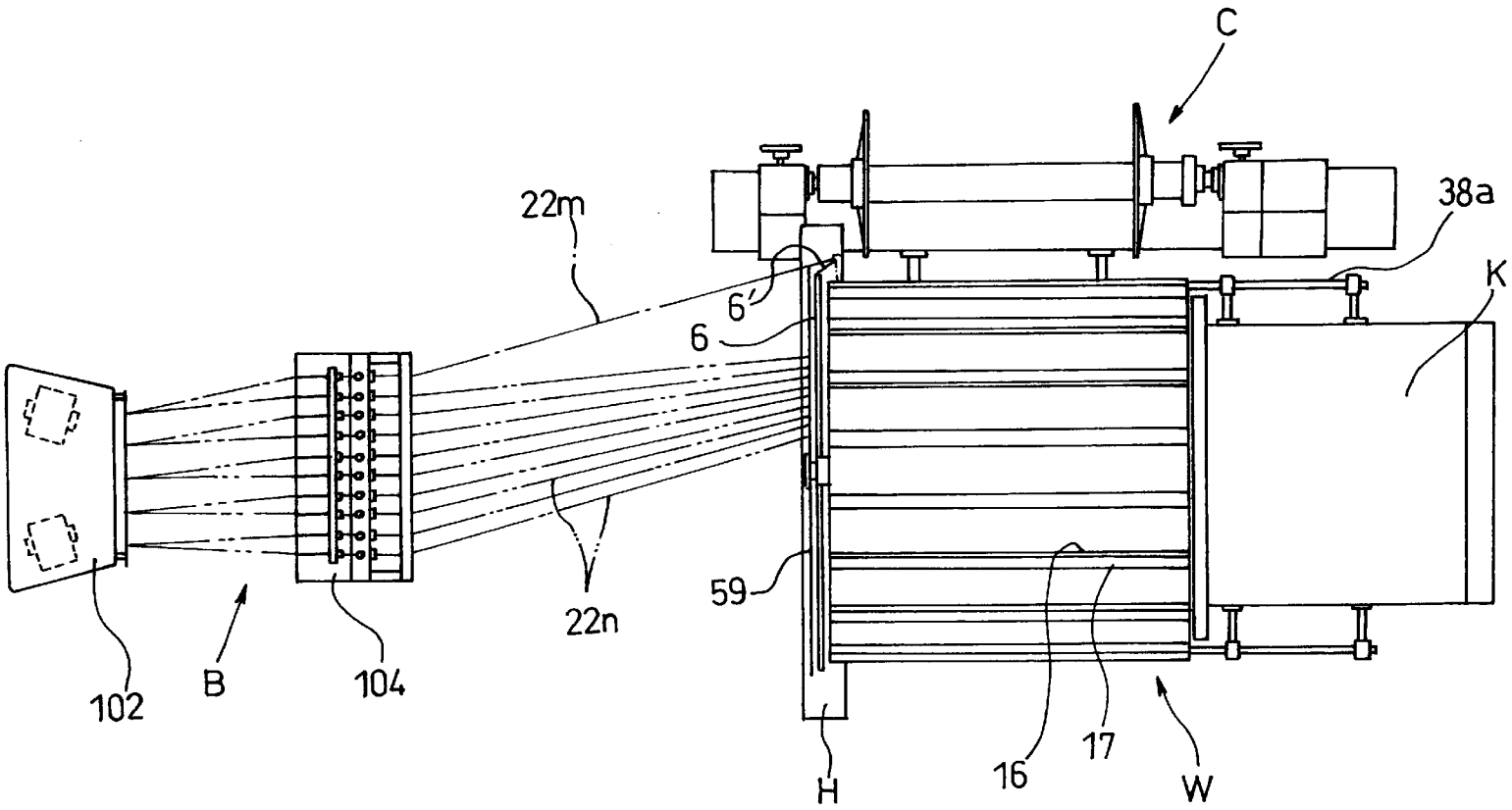
FIG. 2 is a schematic top plan view of the electronically controlled sample warper illustrated in FIG. 1.
Figure 3:
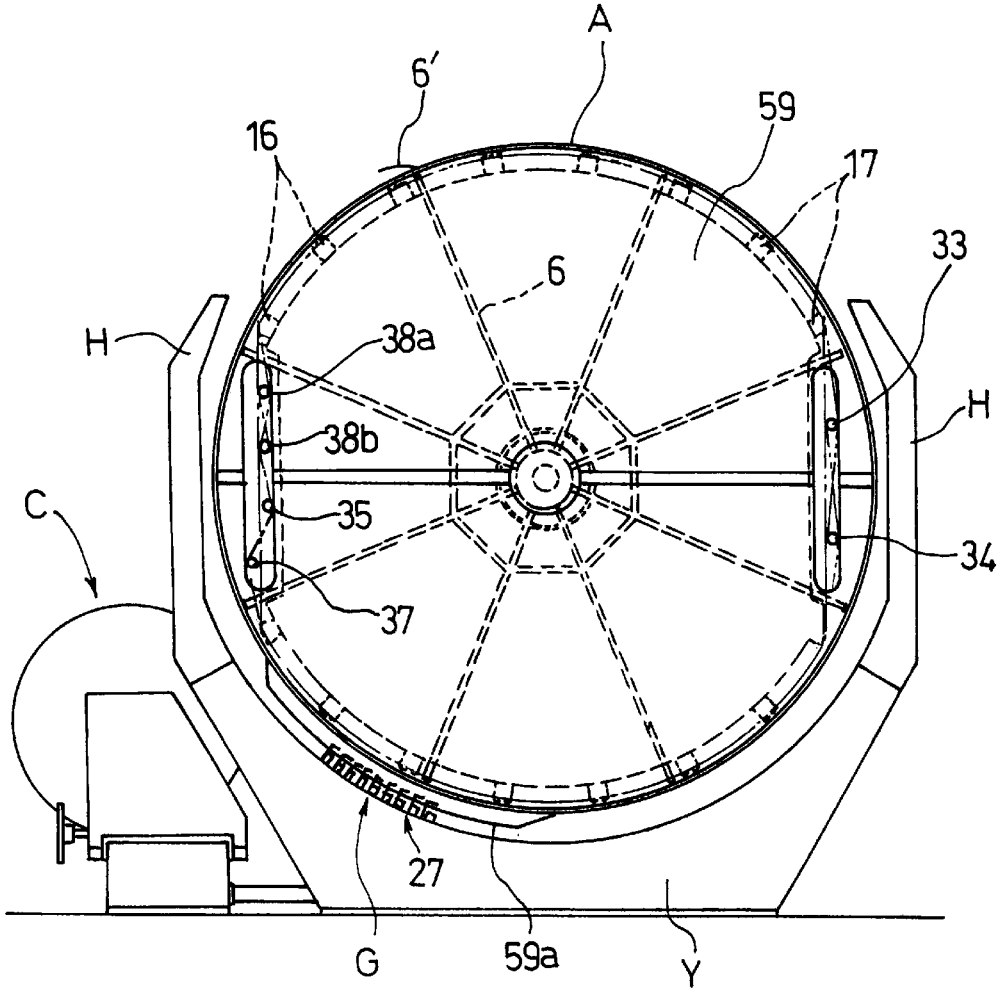
FIG. 3 is a schematic front view of the electronically controlled sample warper illustrated in FIG. 1.
Figure 4:
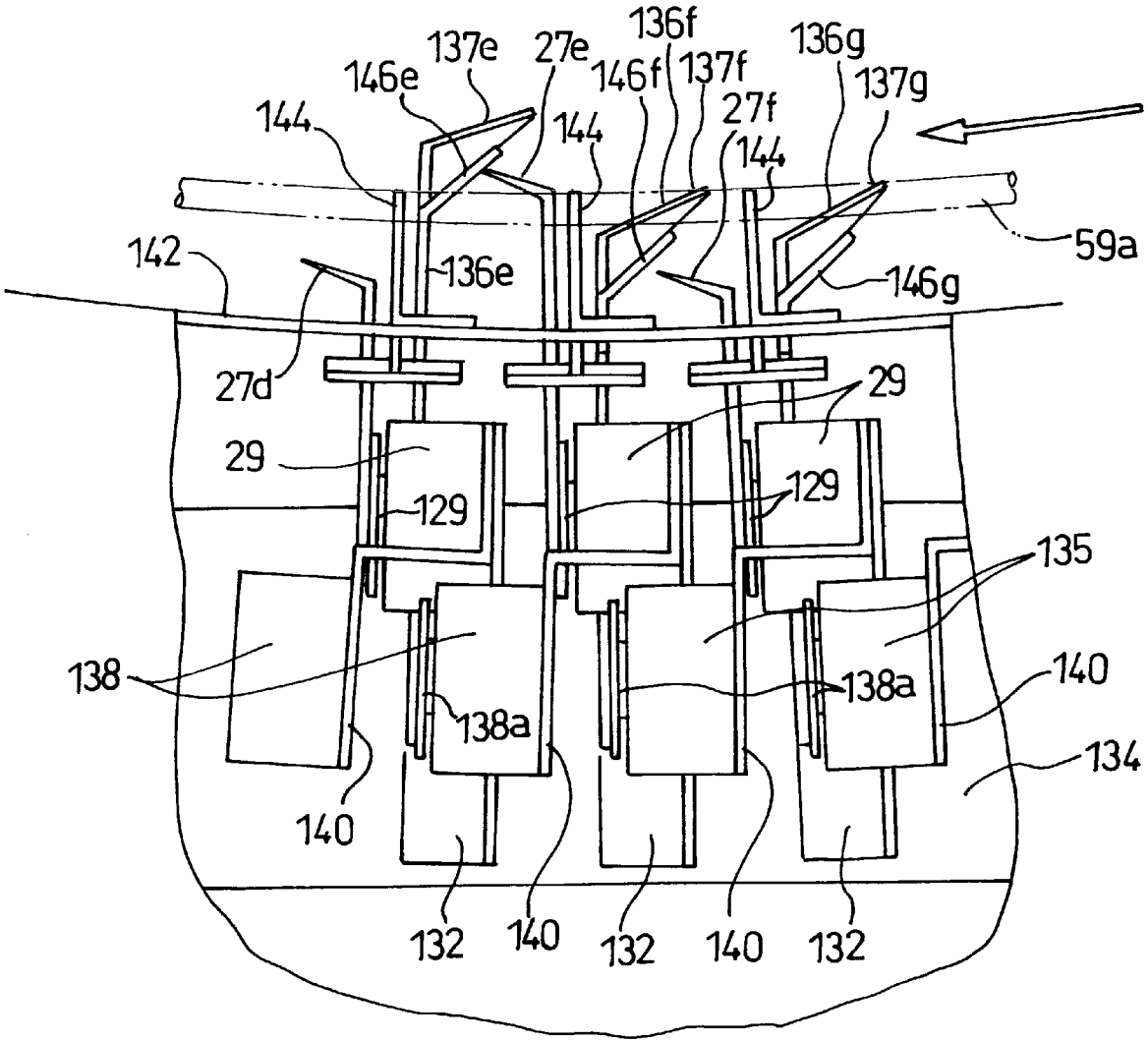
FIG. 4 is a schematic diagram of a main portion of a yarn exchange mechanism according to the present invention.
Figure 5:
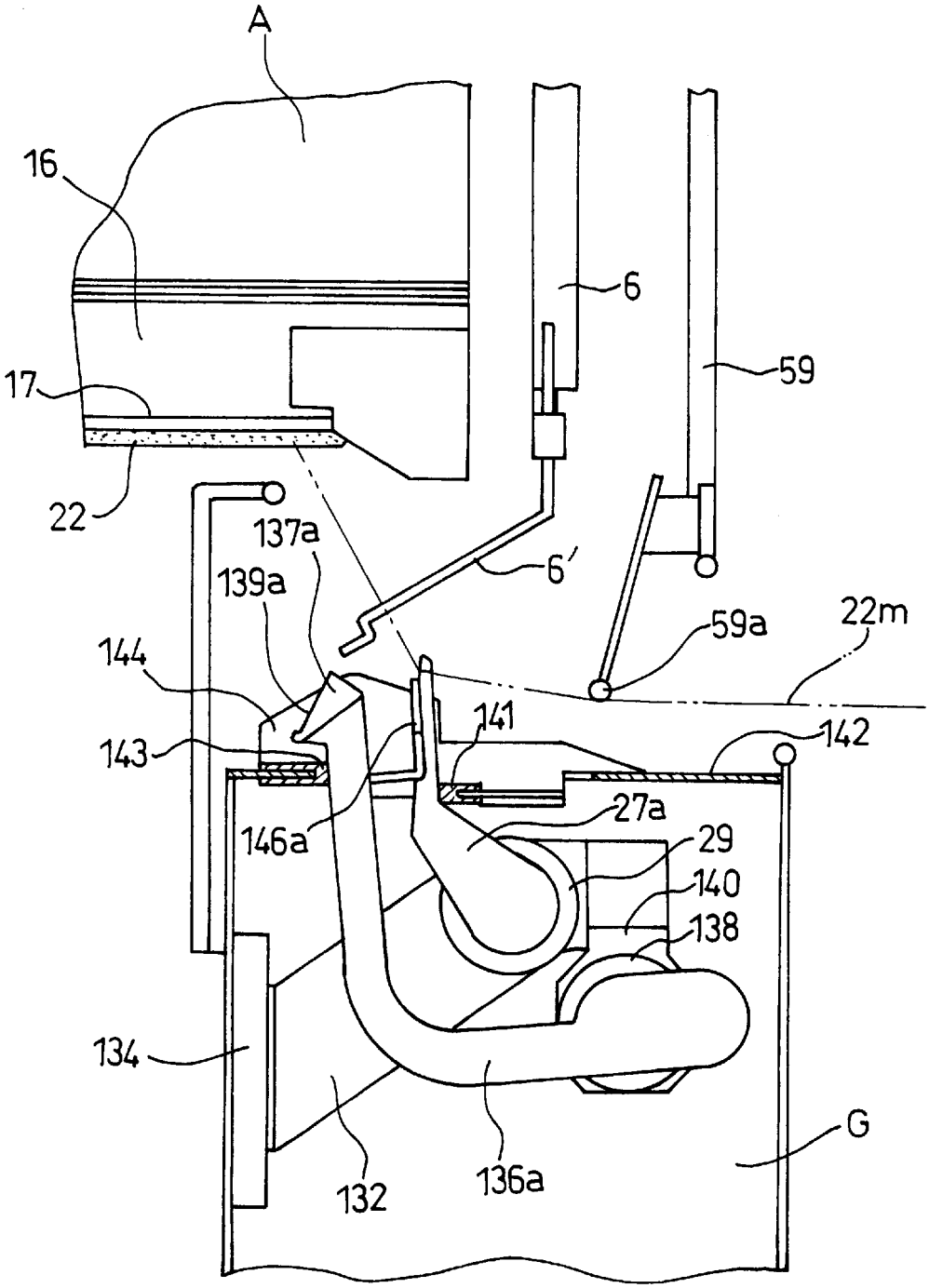
FIG. 5 is a schematic diagram illustrating an operational step ① of the yarn exchange mechanism of the present invention, wherein a yarn selection guide having a yarn held therein has been pivotally moved to a yarn exchange position.
Figure 6:
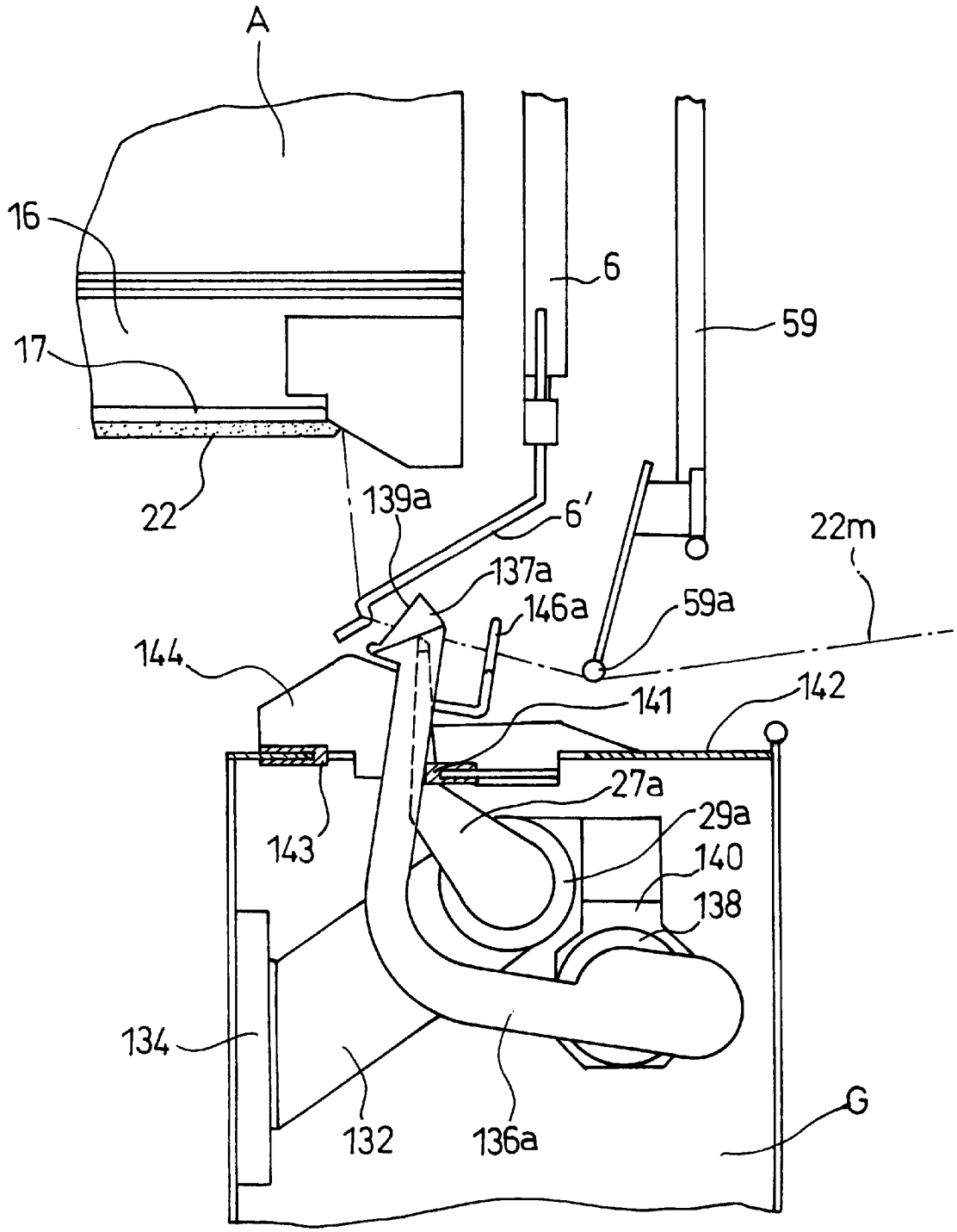
FIG. 6 is a schematic diagram illustrating an operational step ② of the yarn exchange mechanism of the present invention, wherein a yarn held by a yarn introduction member is removed from the yarn introduction member by a yarn removing guide.
Figure 7:
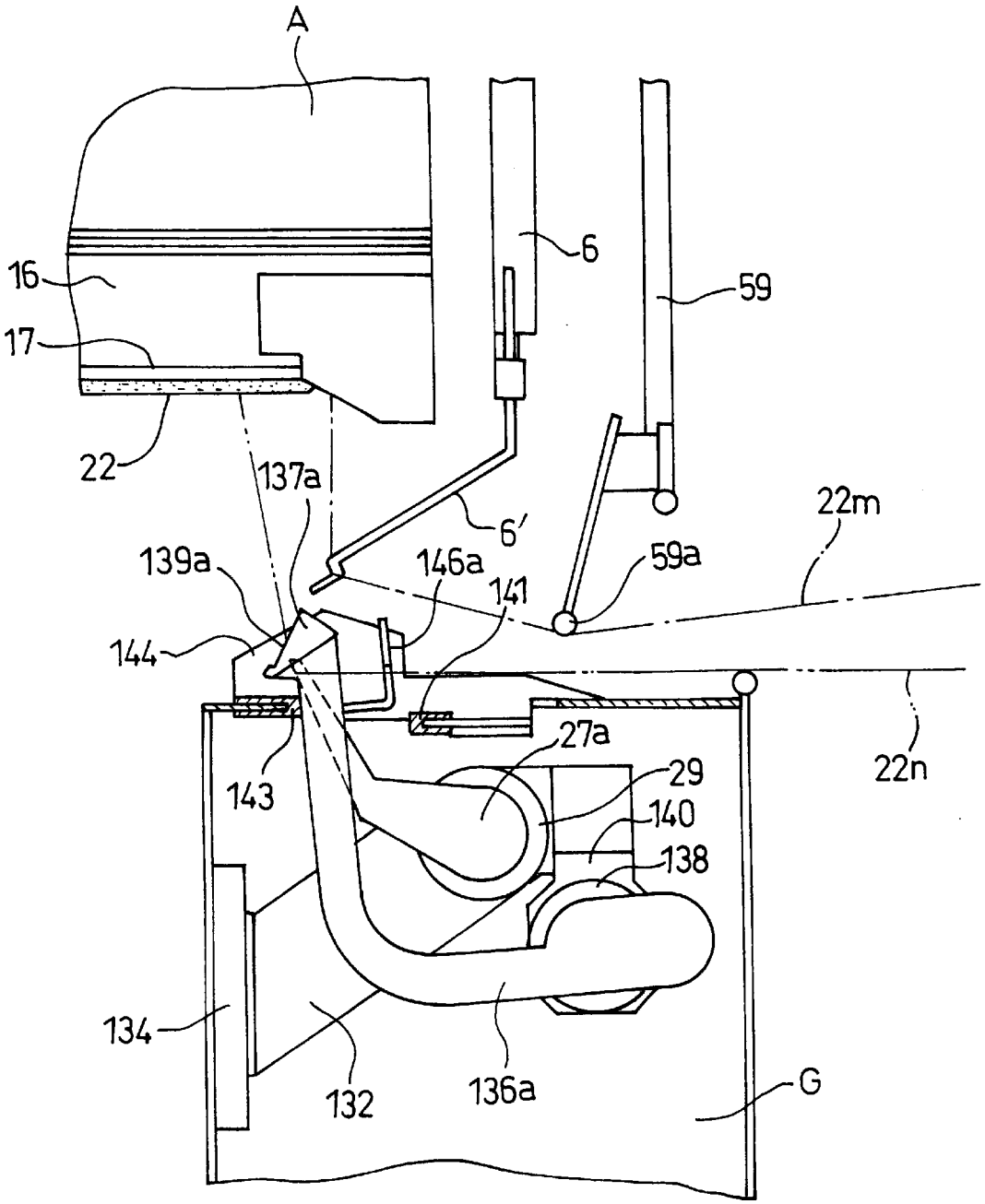
FIG. 7 is a schematic diagram illustrating an operational step ③ of the yarn exchange mechanism of the present invention, wherein the yarn removed in the operational step ② is accommodated in a yarn selection guide, and another yarn is being wound on a warper drum by a yarn introduction member.

FIG. 1 is a schematic lateral view of an electronically controlled sample warper according to the present invention. FIG. 2 is a schematic top plan view of the electronically controlled sample warper illustrated in FIG. 1. FIG. 3 is a schematic front view of the electronically controlled sample warper illustrated in FIG. 1. FIG. 4 is a schematic diagram of a main portion of a yarn exchange mechanism according to the present invention. FIG. 5 is a schematic diagram illustrating an operational step ① of the yarn exchange mechanism of the present invention, wherein a yarn selection guide having a yarn held therein has been pivotally moved to a yarn exchange position. FIG. 6 is a schematic diagram illustrating an operational step ② of the yarn exchange mechanism of the present invention, wherein a yarn held by a yarn introduction member is removed from the yarn introduction member by a yarn removing guide. FIG. 7 is a schematic diagram illustrating an operational step ③ of the yarn exchange mechanism of the present invention, wherein the yarn removed in the operational step ② is accommodated in a yarn selection guide, and another yarn is being wound on a warper drum by a yarn introduction member.

Figure 8:
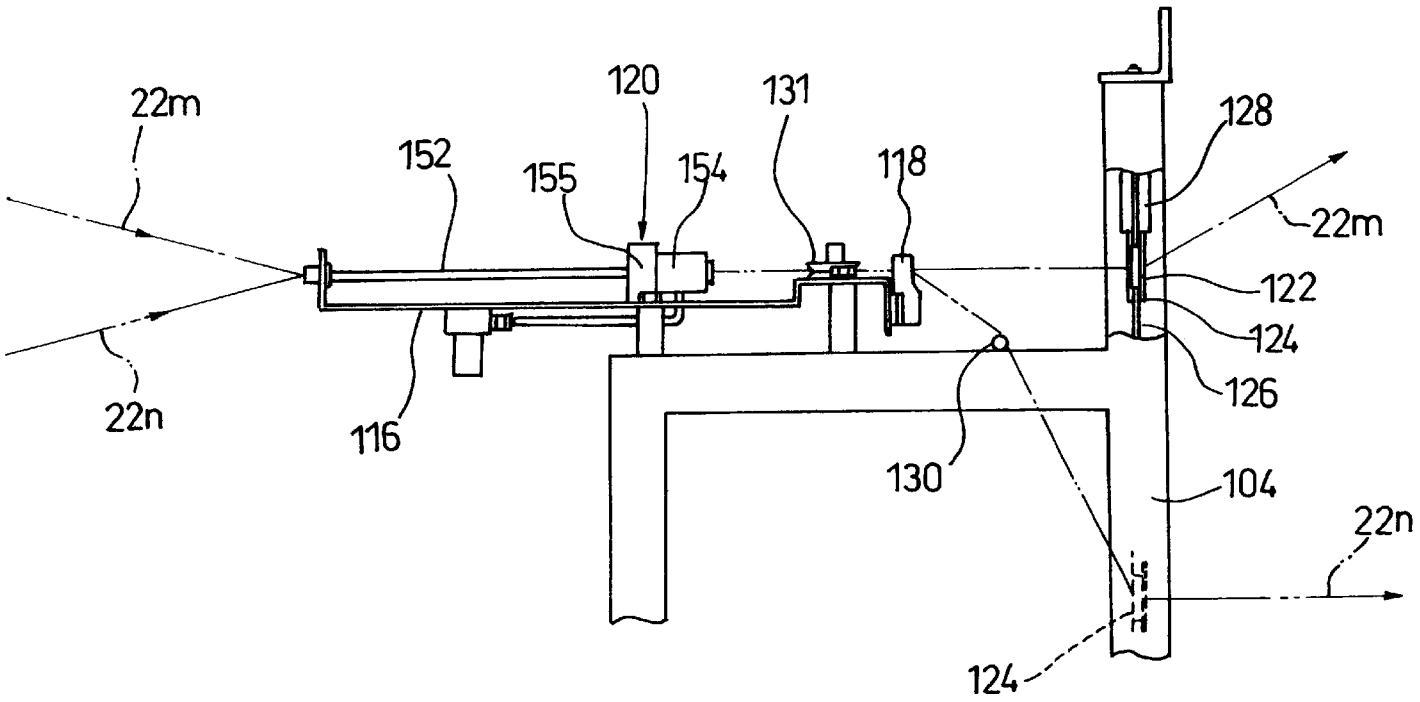
FIG. 8 is a schematic lateral view illustrating an example of a yarn draw-back device.
Figure 9:
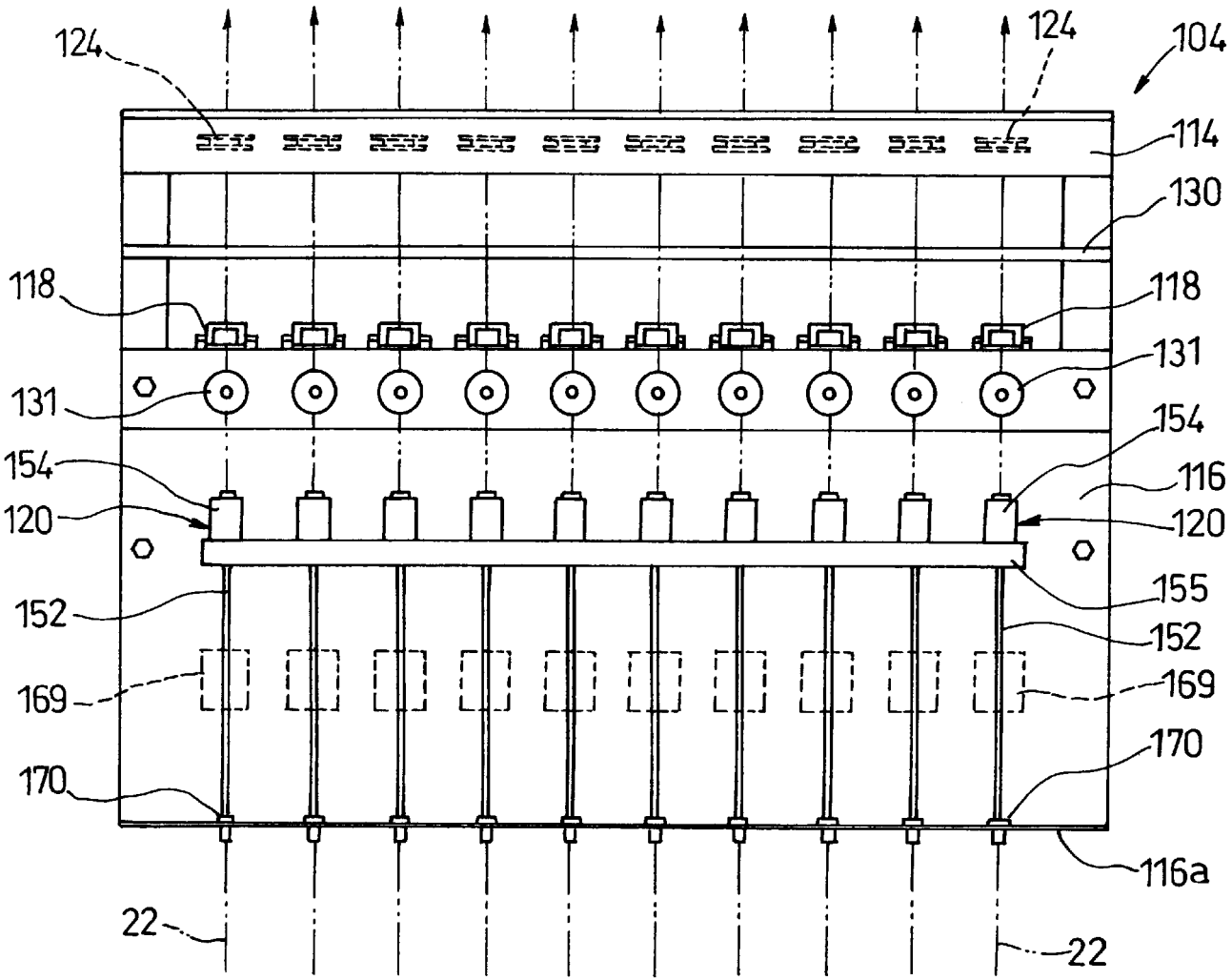
FIG. 9 is a schematic top plan view of the yarn draw-back device illustrated in FIG. 8.
Figure 10:
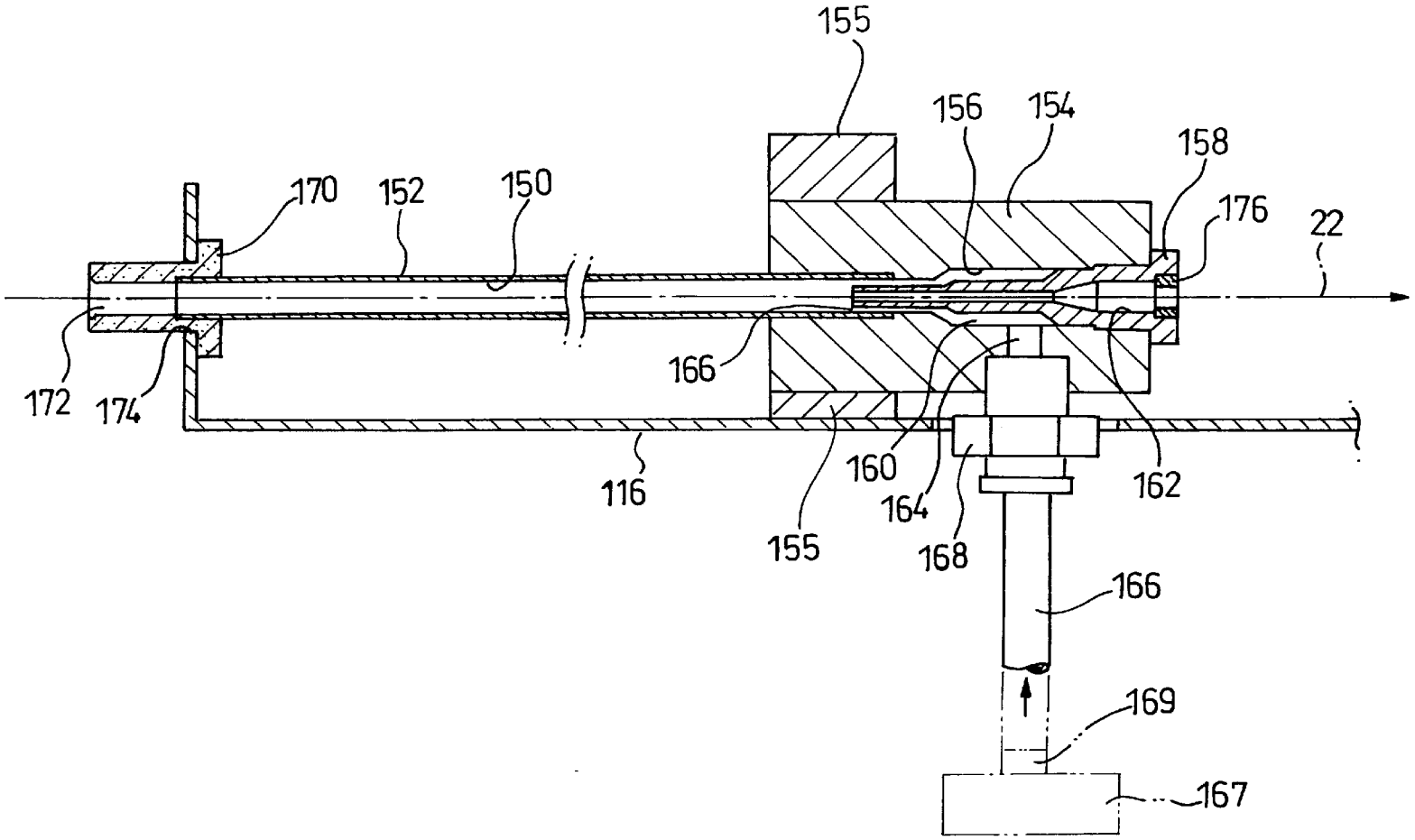
FIG. 10 is a cross-sectional view of the yarn draw-back device illustrated in FIG. 8.
Figure 11:
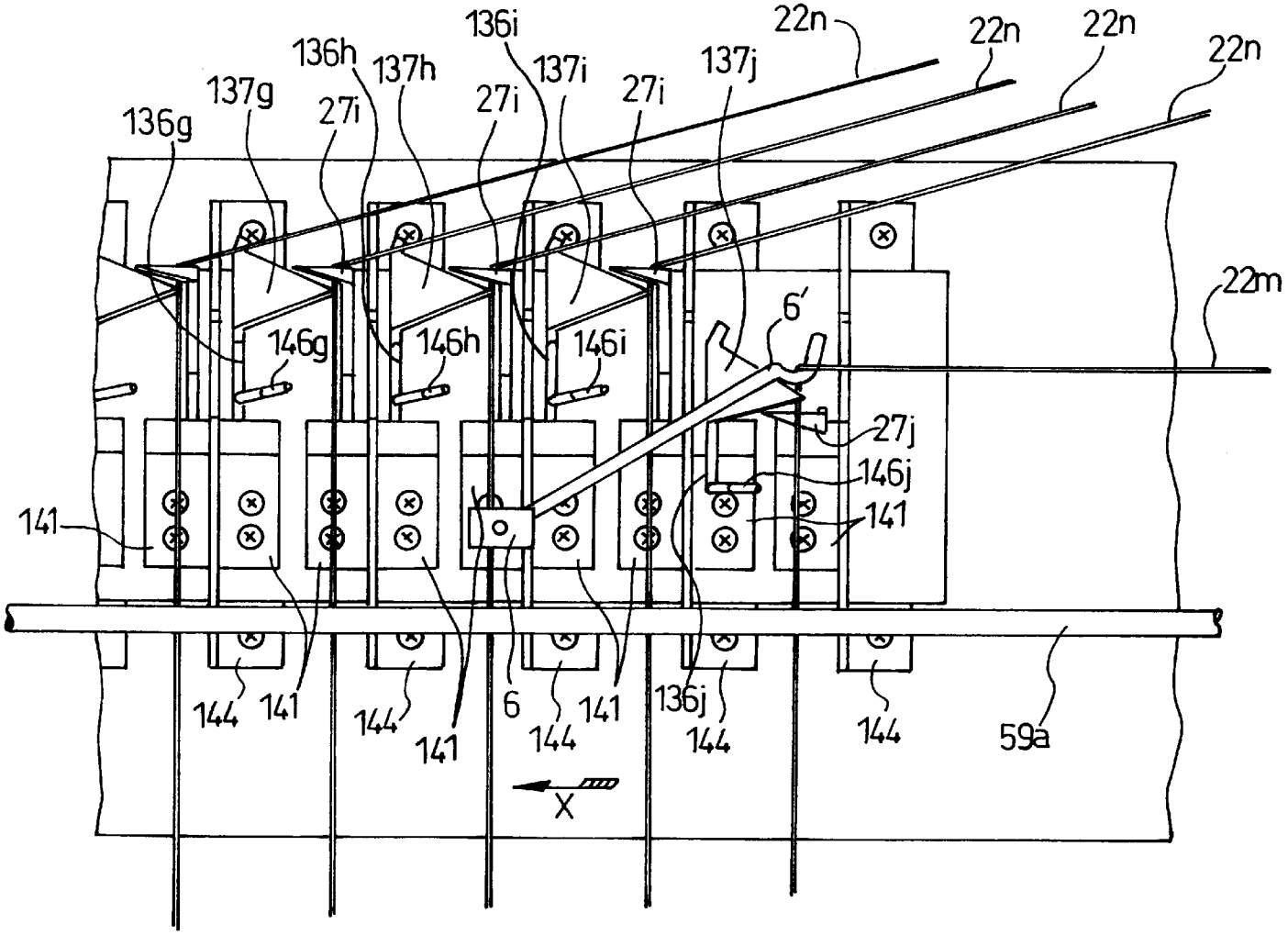
FIG. 11 is a schematic diagram illustrating a yarn removing operational step ① of the present invention, wherein a yarn removing guide and a yarn selection guide had been pivotally moved to the yarn exchange position and a yarn introduction member has been rotated.

FIG. 8 is a schematic lateral view illustrating an example of a yarn draw-back device. FIG. 9 is a schematic top plan view of the yarn draw-back device illustrated in FIG. 8. FIG. 10 is a cross-sectional view of the yarn draw-back device illustrated in FIG. 8. FIG. 11 is a schematic diagram illustrating a yarn removing operational step ① of the present invention, wherein a yarn removing guide and a yarn selection guide had been pivotally moved to the yarn exchange position and a yarn introduction member has been rotated.

Figure 12:
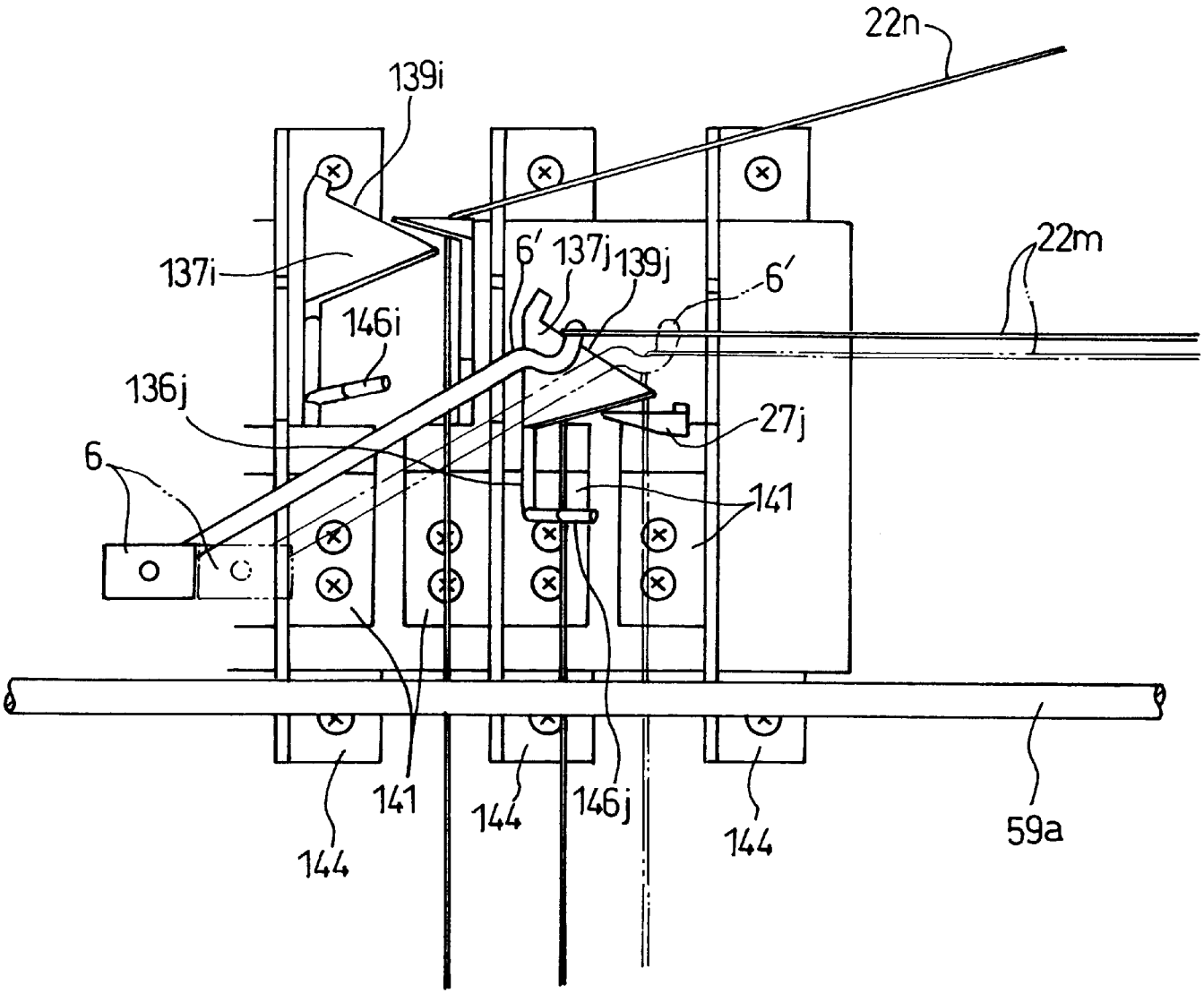
FIG. 12 is a schematic diagram illustrating a yarn removing operational step ② of the present invention, wherein a yarn positioned on a guiding oblique side is sliding on the guiding oblique side and is about to come off a yarn introduction member when a yarn introduction member having a yarn held therein has been rotated by a predetermined angular distance from the state illustrated in FIG. 11.
Figure 13:
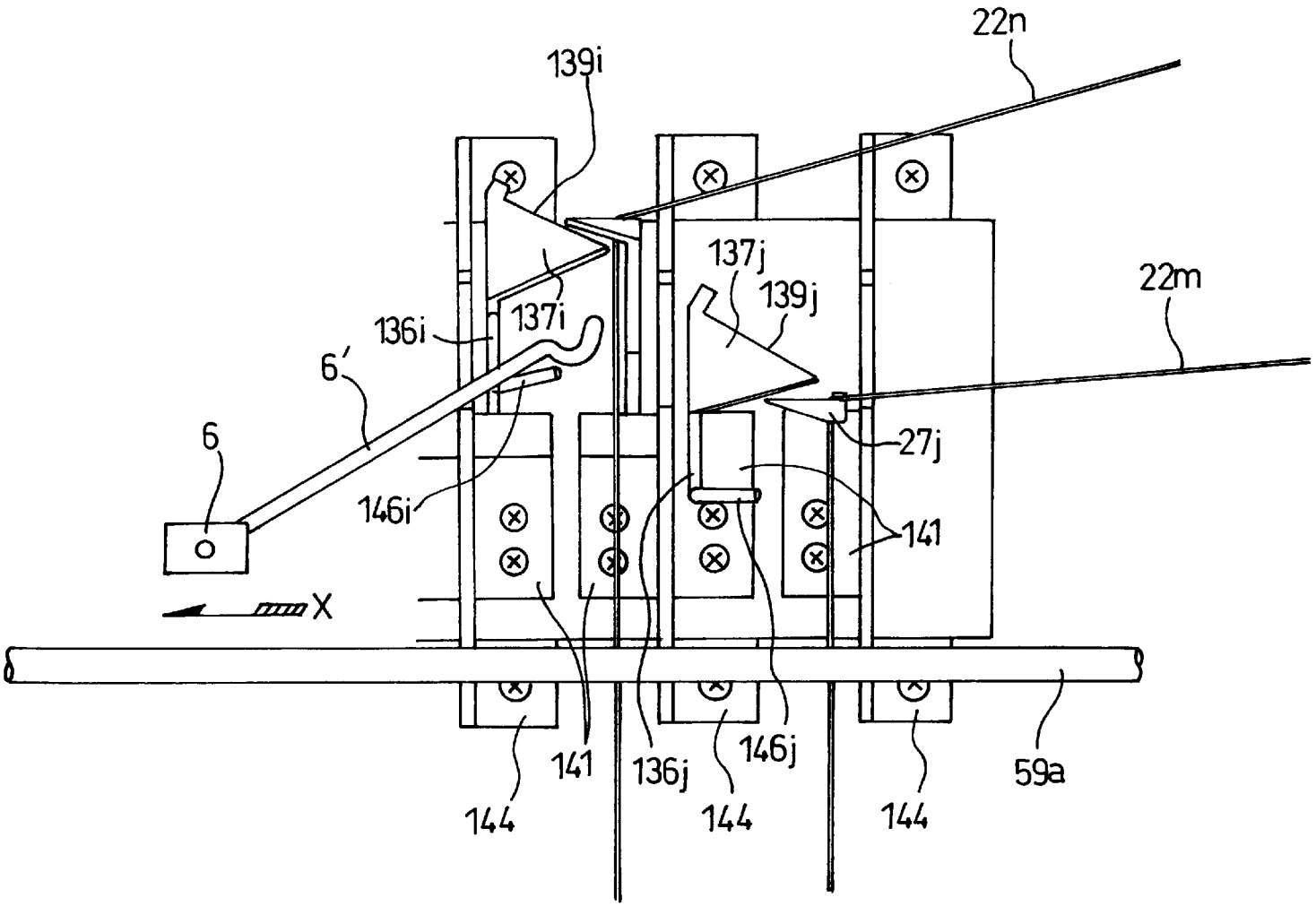
FIG. 13 is a schematic diagram illustrating a yarn removing operational step ③ of the present invention, wherein the yarn which has slid on the guiding oblique side of the yarn removing guide come off the yarn introduction member and is accommodated in a yarn selection guide.
Figure 14:
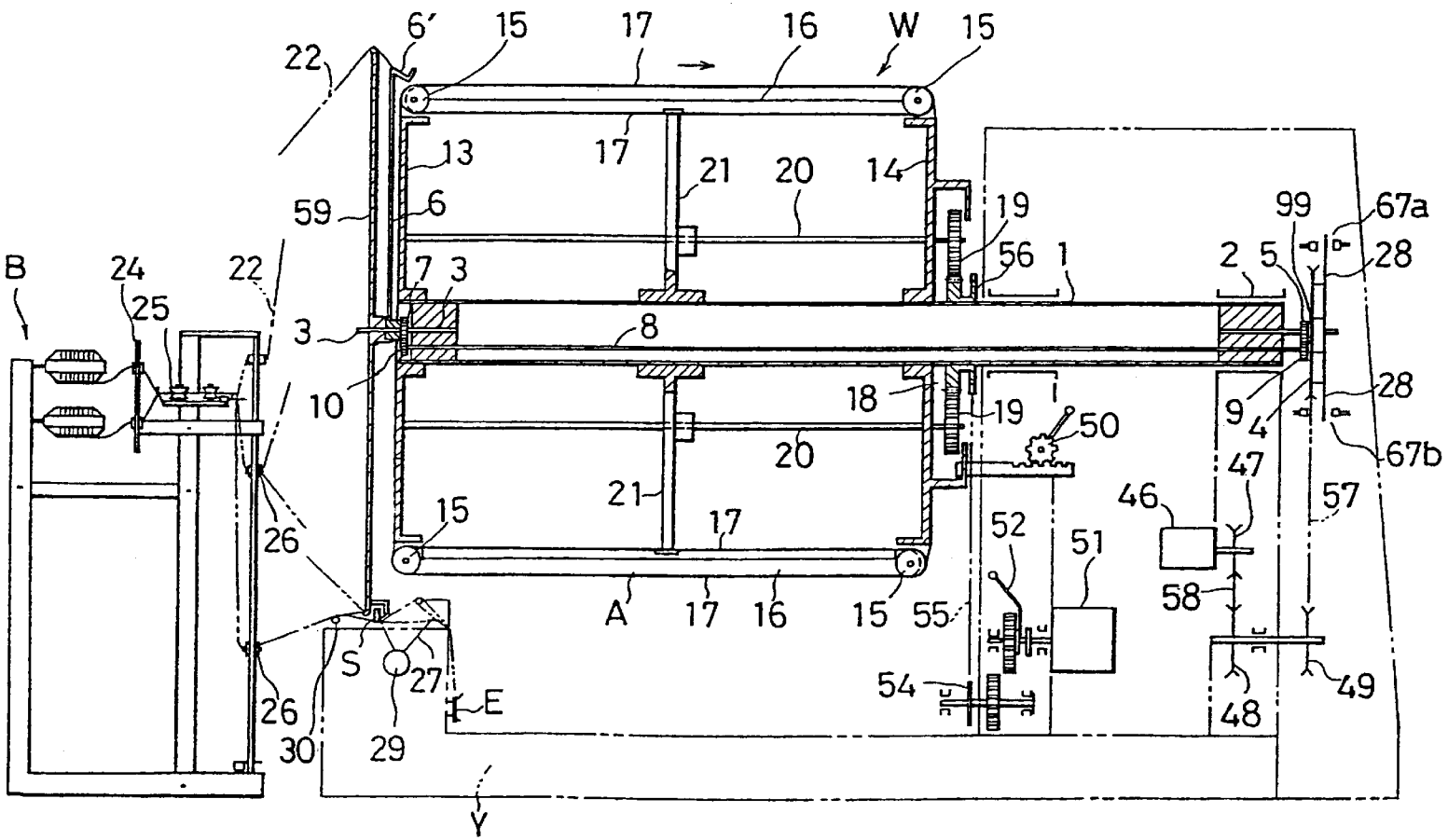
FIG. 14 is a schematic lateral view of a conventional electronically controlled sample warper.
Figure 15:
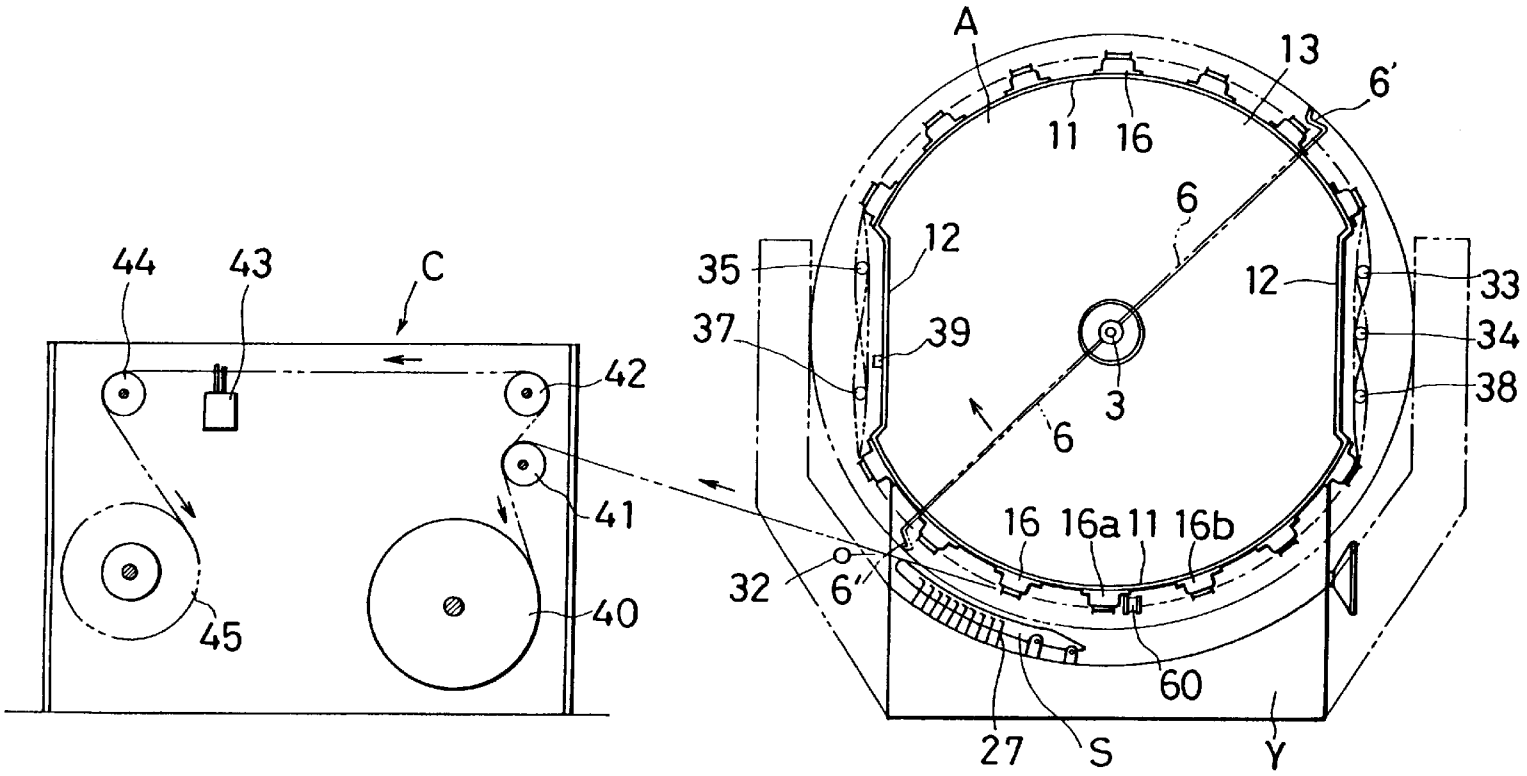
FIG. 15 is a schematic top plan view of the conventional electronically controlled sample warper illustrated in FIG. 14.
Figure 16:
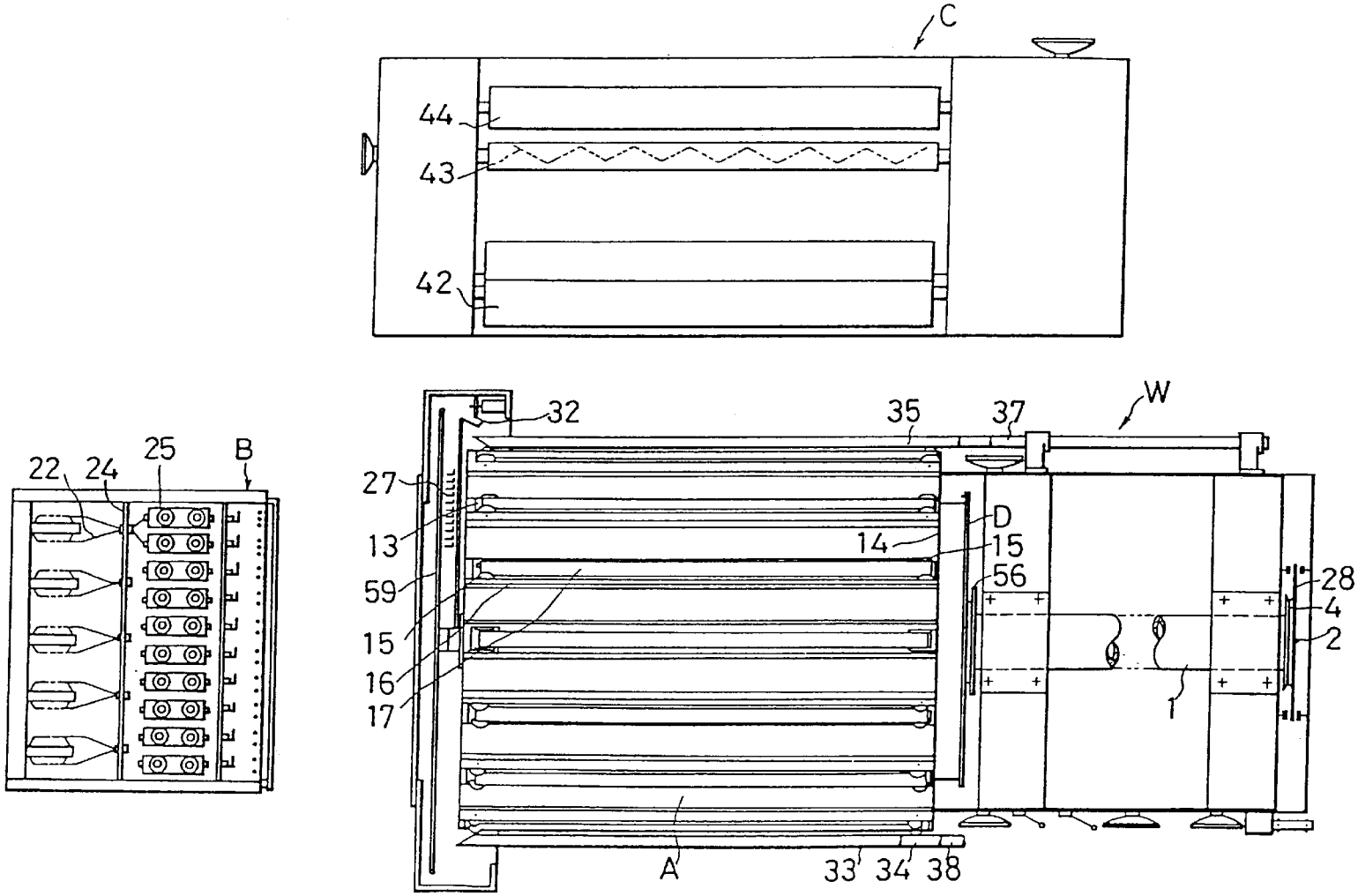
FIG. 16 is a schematic top plan view of the conventional electronically controlled sample warper illustrated in FIG. 14.
Figure 17:
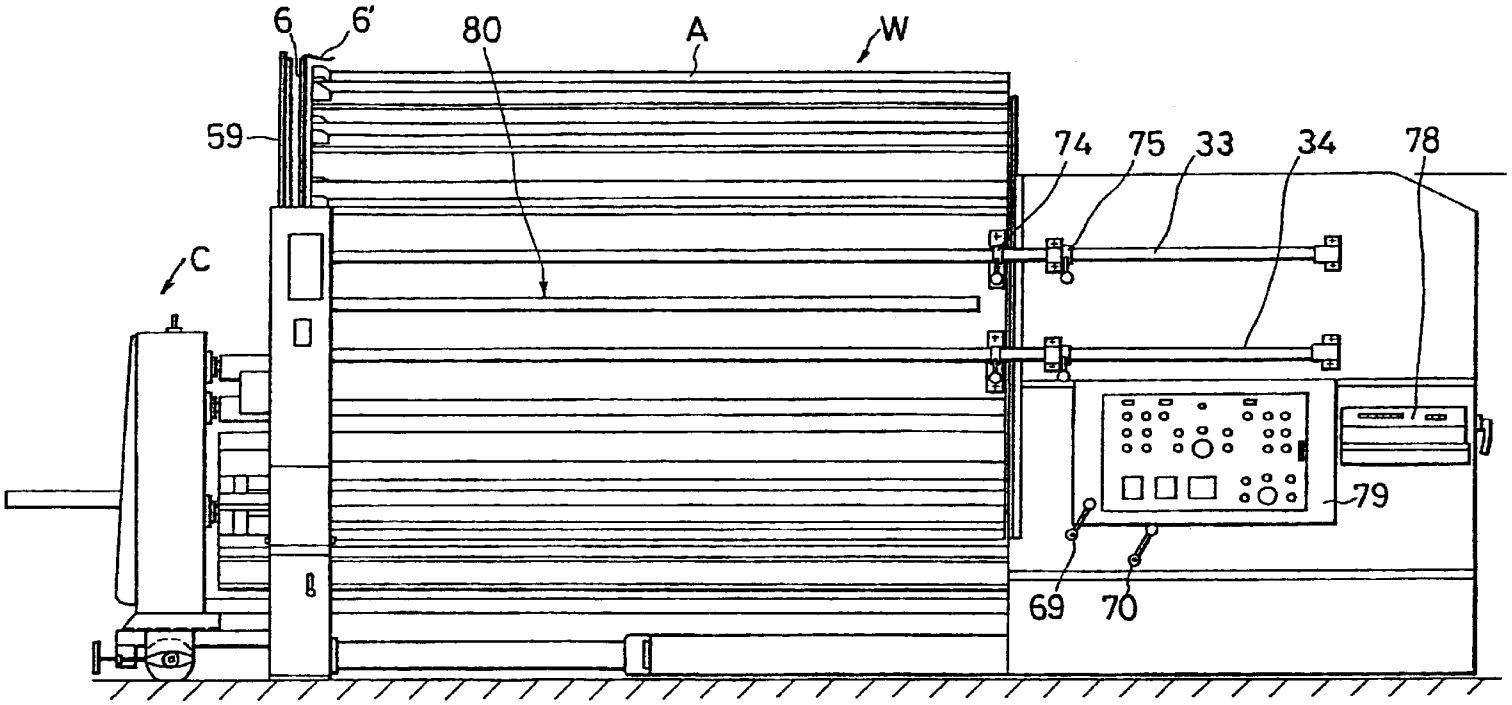
FIG. 17 is a schematic lateral view of the conventional electronically controlled sample warper illustrated in FIG. 14.

FIG. 12 is a schematic diagram illustrating a yarn removing operational step ② of the present invention, wherein a yarn positioned on a guiding oblique side is sliding on the guiding oblique side and is about to come off a yarn introduction member when a yarn introduction member having a yarn held therein has been rotated by a predetermined angular distance from the state illustrated in FIG. 11. FIG. 13 is a schematic diagram illustrating a yarn removing operational step ③ of the present invention, wherein the yarn which has slid on the guiding oblique side of the yarn removing guide comes off the yarn introduction member and is accommodated in a yarn selection guide.

Referring first to FIGS. 1–3, an electronically controlled sample warper W according to the present invention basically has a similar structure and operations to the prior art electronically controlled sample warper illustrated in FIGS. 14–18, except for characteristic features and operations of the present invention, later described.

Specifically, while the illustrated embodiment of the present invention differs from the aforementioned prior art warper in the structure of the fixed creel B, the structure of the rewinder C, positioning of the shed bars 33, 34, 38 and the cut shed bars 35, 37, removal of the stopper plate S, and so on, the basic structure and operations of the electronically controlled sample warper W itself are not changed, so that repetitive detailed explanation thereof is omitted. It should be noted that while a controller 79 illustrated in FIG. 1 is provided with a program setting unit similarly to that shown in FIG. 17, the illustration of the program setting unit is omitted for convenience of illustration.

As illustrated, the electronically controlled sample warper W of the present invention comprises a plurality of yarn introduction means 6 rotatably mounted to a side surface of a warper drum A for winding yarns 22 around the warper drum A, and a plurality of yarn selection guides 27*a*–27*j*, mounted at one end portion of a base Y for supporting the warper drum A, corresponding to the respective yarn introduction means 6 such that they are pivotally moved to protrude to a yarn exchange position when yarns are exchanged and pivotally moved to retract to a standby position when yarns are accommodated. The electronically controlled sample warper W passes the yarns 22 between the yarn introduction means 6 and the yarn selection guides 27*a*–27*j* to automatically pass the yarns 22 to wind the yarns 22 on the warper drum A in accordance with a preset yarn order.

In FIG. 1, the electronically controlled sample warper W further comprises a yarn exchange unit G, a side cover H, a viewing window J, and a motor section K.

As is illustrated in FIGS. 1 and 2, in the electronically controlled sample warper of the present invention, a fixed creel B for supporting a plurality of bobbins 100 around which different kinds of yarns (yarns of different colors or differently twisted yarns) is installed in a positional relationship with the plurality of yarn selection guides 27*a*–27*j* unique to the present invention, later described.

Yarns 22 in the fixed creel B are accommodated in the plurality of yarn selection guides 27*a*–27*j*, respectively, in such a manner that the yarns 22 in the fixed creel B may be sequentially wound on the warper drum A.

The fixed creel B includes a bobbin stand 102 and a creel stand 104. The bobbin stand 102 has a bobbin frame 108 including casters 106 secured on the bottom surface thereof. An appropriate number of bobbins 110 are mounted on the rear end side of the bobbin frame 108. A guide plate 112 is attached at a position in front of each of the bobbins 110.

The creel stand 104 has a base frame 114 including casters 106 secured on the bottom surface thereof. A tension base 116 is installed on a rear portion of the top surface of the base frame 114 as well illustrated in FIGS. 8 and 9. The tension base 116 acts to regulate a tension of a yarn 22. A double winding/mischange sensor 118 is attached to a distal end of the tension base 116. A yarn draw-back device 120 is mounted on the top surface of the tension base 116.

As illustrated well in FIGS. 8 and 9, vertical guide rods 126 corresponding in number to the number of mounted drop rings 124 are implanted on a front surface of the base frame 114 for vertically movably supporting the drop rings 124 each formed with a yarn throughhole 122 extending through a central portion thereof. A drop ring stopper 128 is mounted to an upper end portion of the vertical guide rod 126. A guide rod 130 for guiding a yarn 22 is mounted at an appropriate position in accordance with warping conditions. A pinch washer 131 for regulating a tension is provided to function as a tension regulator.

Therefore, the yarn 22 wound around the bobbin 110 is threaded into a yarn throughhole 122 via the guide plate 112, the yarn draw-back device 120, the tension regulator 131 and the double winding/mischange detecting sensor 118.

As illustrated in FIGS. 1 and 8, since a yarn 22*m* has its leading end wound on the warper drum A through the yarn introduction means 6 during warping, the yarn has a varying tension which causes the drop ring 124 to correspondingly move up and down. On the other hand, since the drop ring 124 is positioned at a lower portion of the guide rod 130, a stationary yarn (a yarn accommodated in the yarn selection guide unit 27) 22 is guided by the yarn selection guide unit 27 through the guide rod 130 and accommodated therein.

As mentioned above, the yarn selection guide unit 27 has a plurality of yarn selection guides 27*a*–27*j*, each of which is pivotally moved by a corresponding rotary solenoid 29 to an operative position (a yarn exchange position in FIG. 5) and to a standby position (a yarn accommodating position in FIG. 7), thus drawing in and out a yarn.

As illustrated in FIGS. 4–7, the yarn selection guides 27*a*–27*j* (27*d*–27*f* are illustrated in FIG. 4, while 27*a* is illustrated in FIGS. 5–7) are each fixed to a pivot plate portion 129 of the selection solenoid 29 implemented by a rotary solenoid, and pivotally moved together with pivotal movement of the pivot plate portion 129. A selection solenoid base 132 associated with the selection solenoid 29 is attached to a selection base 134 secured on an inner surface of a yarn exchange unit G.

Yarn removing guides 136*a*–136*j* (in the illustrated example, 136*e*–136*g* are illustrated in FIG. 4, while 27*a* is illustrated in FIGS. 5–7) are positioned to form pairs with the yarn selection guides 27*a*–27*j*, respectively. The yarn removing guides 136*a*–136*j* are each fixed to a pivot plate portion 138*a* of the yarn removing solenoid 138 implemented by a rotary solenoid positioned near the selection solenoid 29, and are pivotally moved together with pivotal movement of the pivot plate portion 138*a*.

A yarn removing solenoid base 140 associated with the yarn removing solenoid 138 is attached to the selection solenoid base 132. Each of the yarn removing guide 136*a*–136*j* is pivotally moved to an operative position (a yarn removing position in FIG. 6) and an inoperative position (standby position in FIGS. 5 and 7), respectively, by a corresponding yarn removing solenoid 138, for performing a yarn removing operation. It should be noted that in FIGS. 5 through 7, a front stopper 141 and a back stopper 143 are stoppers which act to restrict outward and inward pivotal movements of the yarn removing guide 136*a*, and are made of rubber cushions in order to reduce shock.

Thus, the yarn selection guides 27*a*–27*j* and the yarn removing guides 136*a*–136*j* form pairs, respectively, in opposition to each other, and are arranged between separators 144 mounted on a selection cover 142 carried on the yarn exchange unit G (FIG. 4).

A plurality of yarn exchange structures formed of the yarn selection guides 27*a*–27*j*, the yarn removing guides 136*a*–136*j* and the separators 144 are made in the same shape, while the illustrated example only has ten yarn exchange structures, any number of yarn exchange structures can be provided as long as the yarn exchange unit G has a sufficient space therefor.

As illustrated in FIGS. 4–7, the yarns election guides 27*a*–27*j* are tapered from their base ends which are attached to the selection solenoids 29. Their respective distal ends are bent in a hook shape in the same direction as the rotating direction of the yarn introduction means 6 (i.e., in the downstream direction). Therefor, even if any of the yarn selection guides 27*a*–27*j* (27*e*–27*f* in the example of FIG. 4 ) has been pivotally moved to and remains at the yarn exchange position, a yarn 22 guided by the yarn introduction means 6 slides on the bent distal end of the yarn selection guide 27*e* and passes over the yarn selection guide 27*e*, thus preventing such an accident that the yarn 22 is caught by the yarn selection guide 27*e*.

Figure 18:
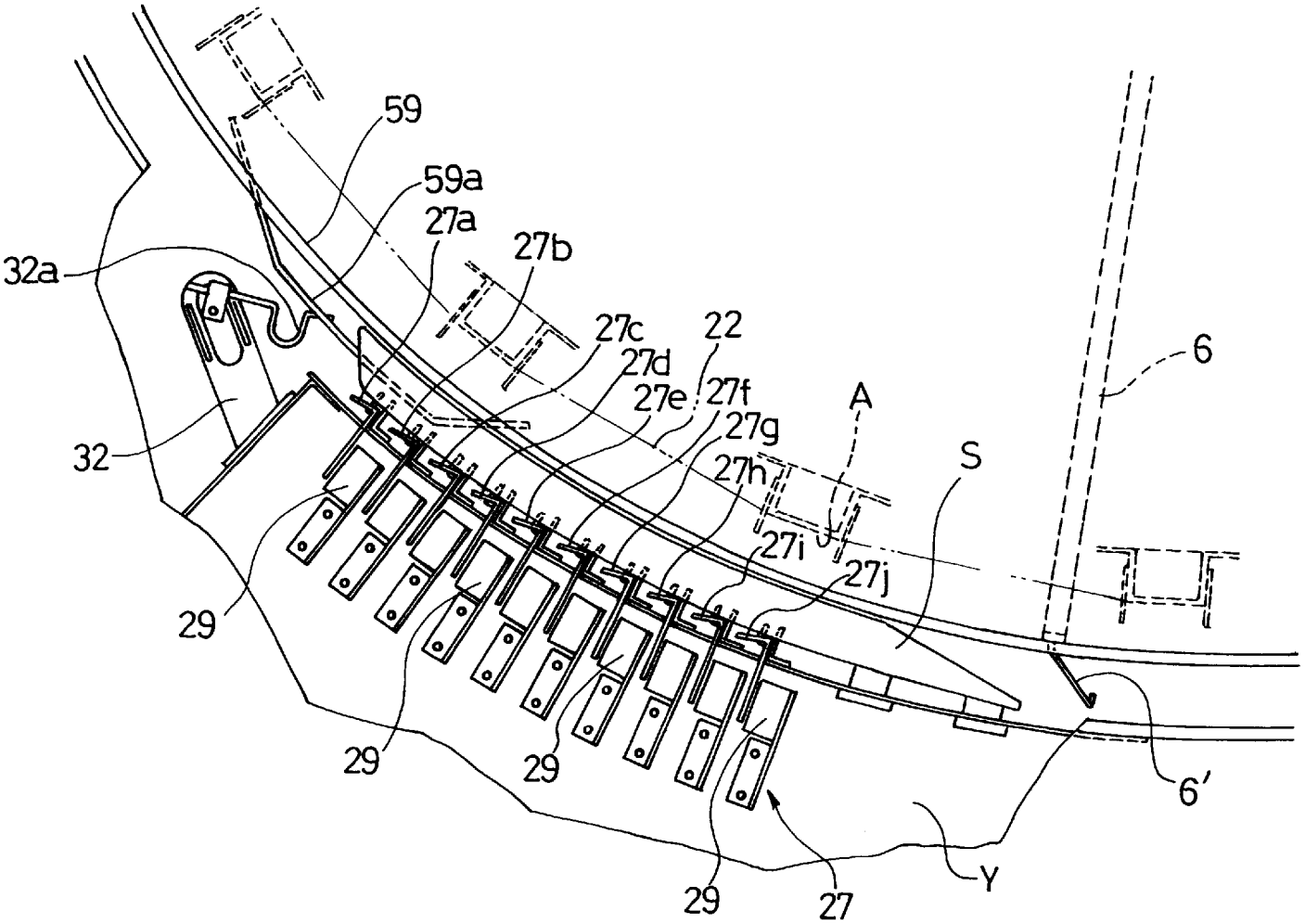
FIG. 18 is a schematic diagram illustrating a conventional yarn exchange mechanism.
Figure 19:
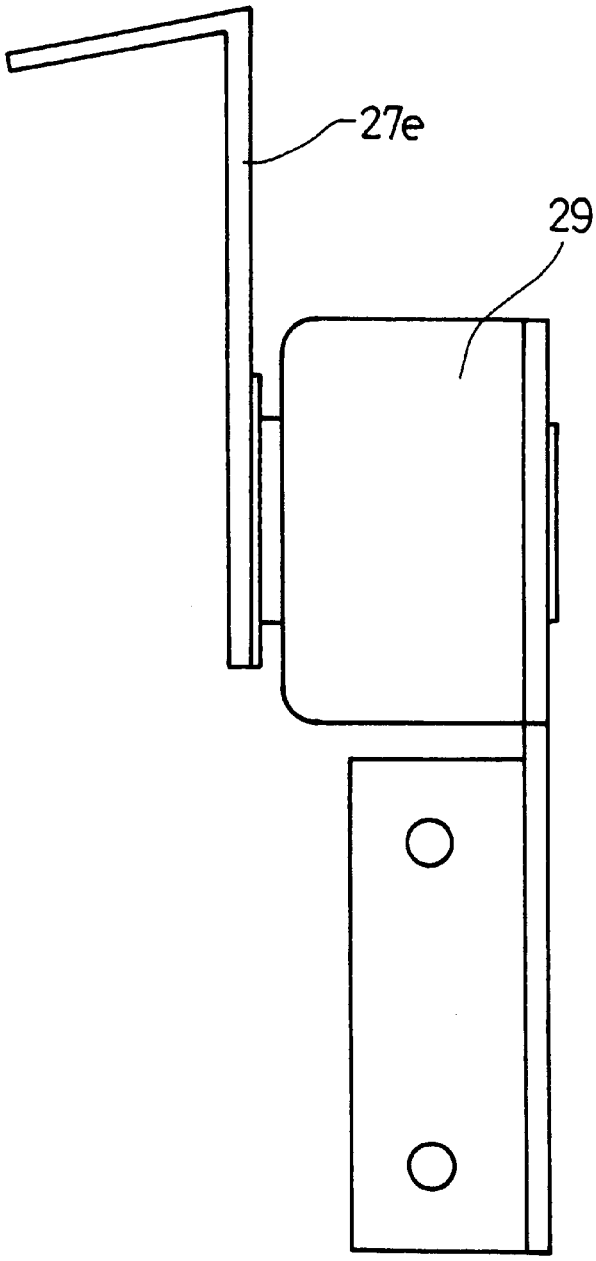
FIG. 19 is a partial lateral view of a conventional yarn selection guide.
Figure 20:
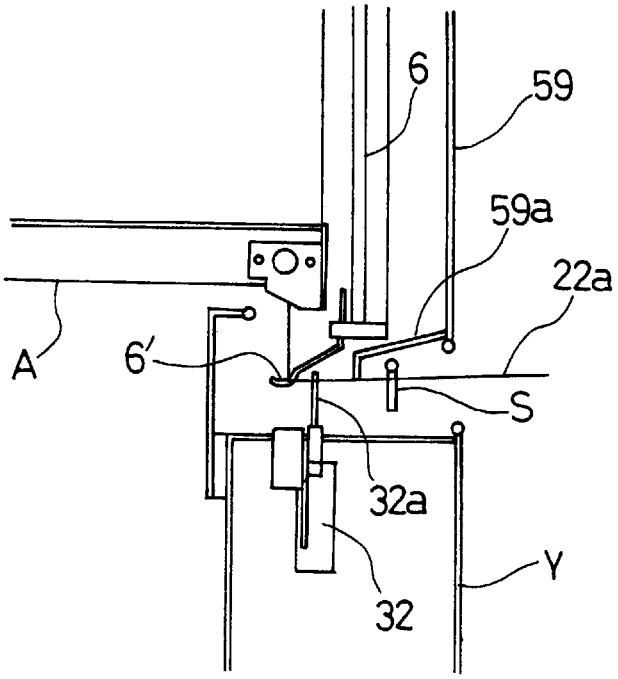
FIG. 20 is a schematic diagram illustrating an operational step ① of the conventional yarn exchange mechanism, wherein a yarn held by a yarn introduction member is removed by a yarn removing guide.
Figure 21:
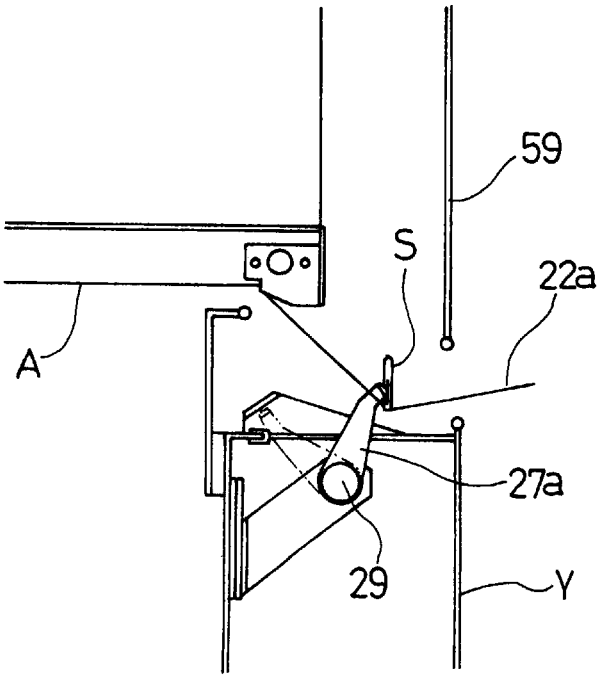
FIG. 21 is a schematic diagram illustrating an operational step ② of the conventional yarn exchange mechanism, wherein the yarn selection guide is pivotally moved to a yarn exchange position, passed a yarn from the yarn introduction means, and hold the yarn.
Figure 22:
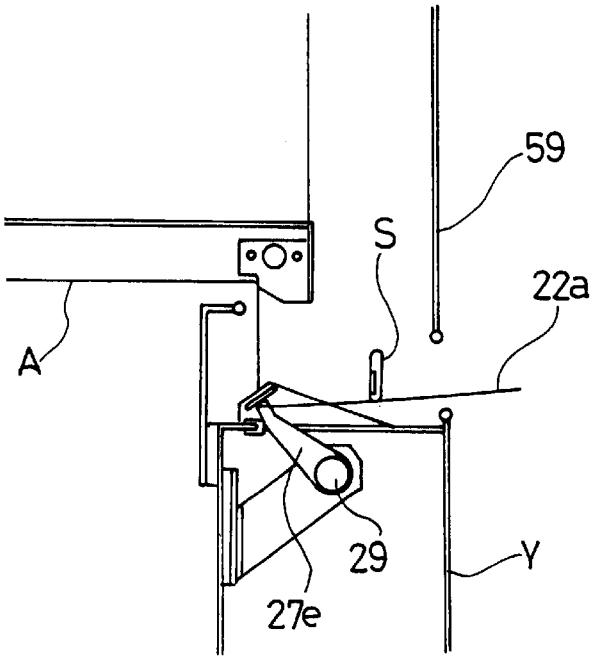
FIG. 22 is a schematic diagram illustrating an operational step ② of the conventional yarn exchange mechanism, wherein the yarn selection guide having a yarn held therein has been pivotally moved to a standby position and accommodated in a base.
Figure 23:
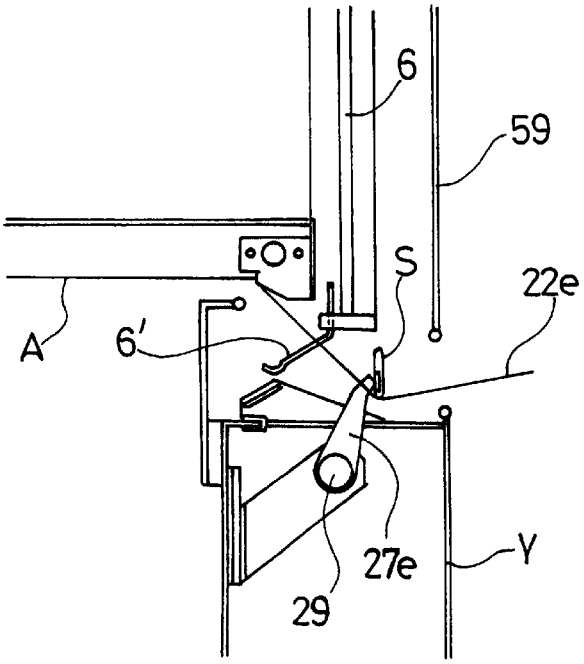
FIG. 23 is a schematic diagram illustrating an operational step ③ of the conventional yarn exchange mechanism, wherein another yarn selection guide holding another yarn is at the yarn exchange position.
Figure 24:
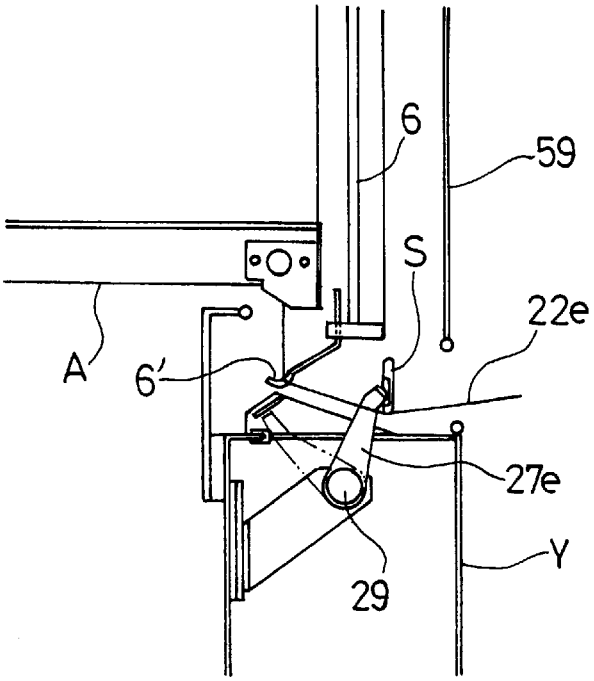
FIG. 24 is a schematic diagram illustrating an operational step ④ of the conventional yarn exchange mechanism, wherein the yarn introduction means passes the yarn exchange position and catches the yarn in the state illustrated in FIG. 23.
Figure 25:
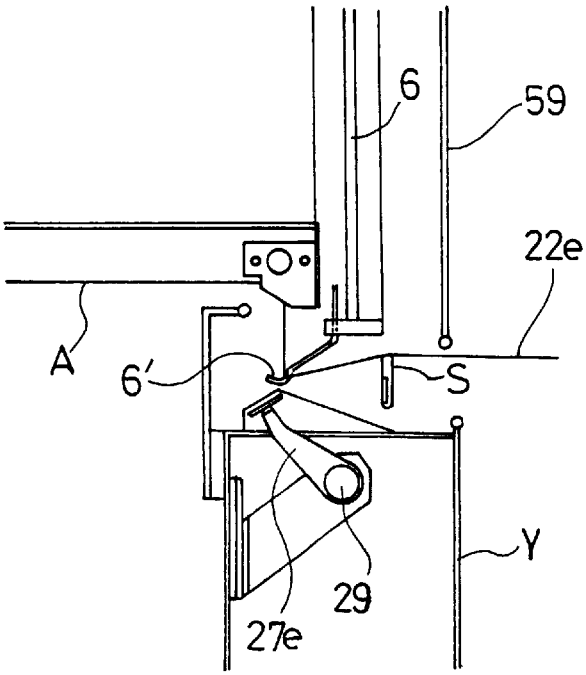
FIG. 25 is a schematic diagram illustrating an operational step ⑤ of the conventional yarn exchange mechanism, wherein a yarn selection guide is accommodated in the base at the standby position, while another yarn is being wound on the warper drum.

On the other hand, with the conventional upright yarn selection guides 27*a*–27*j* illustrated in FIGS. 18 and 19 (27*e* in the example of FIG. 19), when the yarn selection guide 27*a*–27*f* is at the yarn exchange position, the yarn 22 will be caught by the distal end of the yarn selection guide and therefore cannot pass.

With the yarn selection guides 27*a*–27*j* of the present invention having the shape as mentioned above, even if the yarn selection guide 27*a*–27*j* has been pivotally moved to the yarn exchange position before a yarn had been passed, the yarn can slide on the bent distal end of the yarn selection guide 27*a*–27*j* and pass, so that the yarn selection guides 27*a*–27*j* may advantageously have been pivotally moved to the yarn exchange positions, before yarns are passed, for performing a yarn exchange operation.

The yarn removing guides 136*a*–136*j* are positioned downstream of the yarn selection guides 27*a*–27*j* relative to the rotating direction of the yarn introduction means 6, and each have a central portion perpendicularly bent to exhibit an L-shape when viewed from a side, so as to avoid colliding with the selection solenoid 29. In addition, the yarn removing guides 136*a*–136*j* are formed with triangular guide portions 137*a*–137*j*, respectively, at the distal ends thereof which are further bent in the reverse direction to the rotating direction of the yarn introduction means 6 (i.e., in the upstream direction) to point to an obliquely upward direction.

The yarn removing guides 136*a*–136*j* are formed with guide rods 146*a*–146*j* in an inverse L-shape protruding from upper portions of the external surfaces. The guide rods 146*a*–146*j* have their distal ends bent in the direction reverse to the rotating direction of the yarn introduction means 6 (i.e., in the upstream direction) to point to an obliquely upward direction. The guide rods 146*a*–146*j* serve to help the yarn removing guides 136*a*–136*j* when they remove yarns 22 from the yarn introduction means 6.

When a yarn 22 is removed from the yarn introduction means 6 by the yarn removing guide 136*a*–136*j* and the guide rod 142*a*–142*j* and accommodated in the yarn selection guide 27*a*–27*j*, the yarn 22 held by the yarn introduction means 6 is caught by the distal end of the yarn removing guide 136*a*, which has been pivotally moved to the yarn removing position, and the distal end of the guide rod 142*a*, as illustrated in FIG. 6 (in the case of 27*a*). The yarn 22 caught by the distal end of the yarn removing guide 136*a* is moved toward the inside, i.e., toward the distal end of the yarn introduction means 6, while sliding on a guide oblique side 139*a*–139*j* (139*a* in FIG. 6), which is a side of the triangular guide portion 137*a*–137*j* (137*a* in FIG. 6) at the distal end of the yarn removing guide 136*a*, and is then removed from the yarn introduction means 6.

The yarn removing operation using the guide oblique side 139*j* of the triangular guide portion 137*j* is illustrated in greater detail in FIGS. 11–13. As illustrated in FIG. 11, a yarn 22*m* held by the yarn introduction means 6 is caught by the distal end of the yarn removing guide 136*j*, which has been pivotally moved to the yarn removing position, and the distal end of the guide rod 142*j*. Next, as illustrated in FIG. 12, the yarn 22*m* caught by the distal end of the yarn removing guide 136*j* is moved toward the inside, i.e., toward the distal end of the yarn introduction means 6, while sliding on the guide oblique side 139*j* of the triangular guide portion 137*j* at the distal end of the yarn removing guide 136*j*, and finally, as illustrated in FIG. 13, removed from the yarn introduction means 6 and accommodated in the yarn selection guide 27*j*.

The yarn 22 caught by the distal end of the guide rod 142, in turn, is guided outwardly along the guide rode 142*a*, in other words, lowered toward the yarn selection guide 27*a*, so as to be accommodated in the yarn selection guide 27*a*. As a result of guiding the yarn 22 in this manner, the yarn 22 is removed from the yarn introduction means 6 with less physical impact applied to the yarn 22, so that the yarn 22 is substantially free from looseness.

The aforementioned yarn draw-back device 120, which has a novel structure utilizing compressed air to rapidly draw back a yarn, will be described below.

The structure of the yarn draw-back device 120 is illustrated in detail in FIG. 10. The yarn draw-back device 120 has a guide tube 152 formed with an inner space 150 through which a yarn 22 passes. An air nozzle support 154 is attached to the distal end of the guide tube 152 through a base holder 155. The base holder 155 in turn is fixed on the tension base 116.

The air nozzle support 154 is formed with a throughhole 156 extending therethrough in the longitudinal direction, and a distal end portion of the guide tube 152 is inserted into a base end portion of the throughhole 156.

An air nozzle 158 is inserted from an distal end opening of the throughhole 156 into the throughhole 156. The air nozzle 158 has a distal end portion with a smaller diameter which is loosely inserted into a central portion of the throughhole 156 so as to form an air blow-in space 160 between the outer peripheral surface of the distal end portion of the air nozzle 158 and the inner peripheral surface of the throughhole 156. The air blow-in space 160 is formed to allow air to be blown into the inner space 150 in the direction opposite to the advancing direction of the yarn 22, i.e., formed such that an air ejection port 161 is open to the direction opposite to the advancing direction of the yarn 22.

The air nozzle 158 has a base end portion with a larger diameter which is fitted in a distal end portion of the throughhole 156. A yarn throughhole 162 extends through the air nozzle 158 in the longitudinal direction such that the yarn 22 can be threaded therethrough.

An air introduction port 164, having an upper end open to the air blow-in space 162 and a lower end open to the downward direction, is formed through a lower portion of the air nozzle 158. An air pipe 166 is attached to the air nozzle support 154 by a joint 168 so as to communicate with the air introduction port 164. The air pipe 166 is connected to an compressed air source 167, and compressed air is turned on (injected) and off (blocked) in response to on/off of a solenoid valve 169 mounted at an appropriate position on the compressed air source 167 or the air pipe 166. Specifically, the compressed air is introduced into the air introduction port 164 when the solenoid valve 169 is turned on, while the compressed air is blocked when the solenoid valve 169 is turned off.

A ceramic guide 170 is formed with a throughhole 172 extending through a central portion thereof for threading a yarn therethrough. The ceramic guide 170 serves to attach the base end of the guide tube 152 to an opening 174 of a base plate 116*a* of the tension base 116. A ceramic ring 176 is mounted to a distal end opening of the air nozzle 158.

The solenoid valve 169 of the compressed air source 167 is turned on/off at the same time as turning on/off of each selection solenoid 29 of the selection guide 27*a*–27*h*. Therefore, compressed air is supplied into the air blow-in port 160 only when a yarn 22 is supplied and when a yarn 22 is accommodated. Specifically, the yarn draw-back device 120 is actuated when the yarn 22 is supplied and accommodated, to apply a tension to the yarn 22 when the yarn 22 is passed or supplied to the yarn introduction means 6 and to draw back looseness of the yarn, if any, to the bobbin 110 while the yarn is removed from the yarn introduction means 6 for accommodation.

The solenoid valve 169 of the compressed air source 167 and the respective selection solenoids 29 of the selection guides 27*a*–27*j* are electrically coupled such that they operate in a corresponding relationship such as NO. 1 selection solenoid 29 with NO. 1 solenoid valve 169; NO. 2 selection solenoid 29 with NO. 2 solenoid valve 169; NO. 3 selection solenoid 29 with NO. 3 solenoid valve 169; NO. 4 selection solenoid 29 with NO. 4 solenoid valve 169; NO. 5 selection solenoid 29 with NO. 5 solenoid valve 169; and so on.

When compressed air flows into the air blow-in space 160, the compressed air is blown out in an opposite direction to a yarn advancing direction, thus making the flow of air opposite to the yarn advancing direction. For this reason, an air flow in an absorbing direction opposite to the yarn advancing direction is completed also within the yarn threading hole 162 of the air nozzle 158, as illustrated in FIG. 10, thus acting a yarn draw-back force to the yarn 22.

As a result, a force in the direction opposite to the yarn advancing direction acts on the yarn 22 threaded through the air nozzle 158 so that the yarn is drawn back when the yarn 22 is loosened and the yarn 22 is applied with a tension when the yarn 22 is tensioned. Also, since the magnitude of this action is determined by the pressure of the compressed air, so that the original pressure of the compressed air is preferably made adjustable using a vacuum valve (regulator), not shown, available on the market.

As described above, by providing the yarn draw-back device 120 on the creel stand 104, the drop ring 124 is freed from the responsibility for removing yarn looseness during a yarn exchange operation. Therefore, the drop ring 124 is only required to have a weight sufficient to prevent yarns 22 accommodated in the yarn selection guides 27*a*–27*j* from fluctuating due to a wind pressure from the yarn introduction means or the like, so that an extremely light weight drop ring 124 is sufficient for this purpose. This structure also provides for a reduction in tension of a yarn under warping, so that the yarn is free from breakage even at a warping yarn speed of 1000 meters/minute or higher (for example, 1500 meters/minute). It is also possible to supply and accommodate yarns while maintaining the yarn warping speed even during yarn exchange.

Description is next made on a warping procedure for the electronically controlled sample warper of the present invention which employs the foregoing structure. First, a bobbin 110 is set on the bobbin stand 102, and a yarn wound around the bobbin 110 is passed through the yarn draw-back device 120 on the creel stand 104, the pinch washer 131 for tension regulation, the double winding/mischange detecting sensor 118 and the drop ring 124, and accommodated in the yarn selection guide 27*a*–27*j* of the yarn exchange unit G of the electronically controlled sample warper W, with the leading end of the yarn fixed to the yarn fastener E. In this event, yarns must be set with the yarn draw-back devices 120 corresponded to the selection numbers of the yarn selection guides 27*a*–27*j,* as described above. If the drop ring 124 has a weight of two grams and a weight carried on the pinch washer 131 for tension regulation is one gram, i.e., if there is a total of more or less three grams, a wide range of different yarns from a fine yarn to a thick yarn can be used.

When a start-up switch of the electronically controlled sample warper W is turned on, one of yarn selection guides 27*a*–27*j* having a indicated number is actuated in accordance with a previously inputted indication of pattern data to move a yarn to the yarn exchange position as illustrated in FIG. 5 (in the illustrated example, the yarn selection guide 27*a*). Simultaneously with this, the solenoid valve 169 of the indicated yarn draw-back device 120 is energized to supply compressed air into the air nozzle 158, resulting in adding a tension to the yarn and also raising the drop ring 124 to the vicinity of a drop ring position during warping illustrated in FIG. 8. Consequently, the yarn extending between the yarn draw-back device 120 and the drop ring 124 is stretched.

Subsequently, the yarn introduction means 6 is rotated to catch the yarn 22 held by the yarn selection guide 27*a,* and the warping is started. Since the drop ring 24 already remains near the same position as during the warping, less impact will be given to the yarn 22 when it is caught by the yarn introduction means 6, thus making the yarn 22 less susceptible to breakage when it is supplied.

When an indicated number of yarns 22 have been warped, a yarn removing guide 136*a*–136*j* having the same number as that of the yarn selection guide 27*a*–27*j* is pivotally moved to the yarn removing position as illustrated in FIG. 6 (in the illustrated example, the yarn removing guide 136*a*). When the yarn introduction means 6 is rotated to the yarn removing position, the yarn 22 is caught by the distal end of the yarn removing guide 136*a* and the distal end of the guide rod 146*a*. Then, the yarn 22 on the yarn introduction means 6 is pressed inwardly (in the direction opposite to the front cover 59) while sliding on the guide oblique side 139*a* of the triangular guide portion 137*a* at the distal end of the yarn removing guide 136*a,* and simultaneously, the yarn 22 is pressed down along the guide rod 146*a* from the central position of the warper drum A to the outside (i.e., toward the yarn selection guide 27*a*), and removed from the yarn introduction means 6.

This yarn removing operation is described in greater detail with reference to FIGS. 11–13. As illustrated in FIG. 11, when the yarn removing guide 136*j* is pivotally moved to the yarn removing position and the yarn introduction means 6 is rotated to this position, a yarn 22*m* is caught by the distal end of the yarn removing guide 136*j* and the distal end of the guide rod 146*j*. Next, as illustrated in FIG. 12, the yarn 22*m* on the yarn introduction means 6 is pressed inwardly (in the direction opposite to the front cover 59) while sliding on the guide oblique side 139*j* of the triangular guide portion 137*j* at the distal end of the yarn removing guide 136*j,* and simultaneously, the yarn 22*m* is pressed down along the guide rod 146*j* from the central position of the warper drum A to the outside (i.e., toward the yarn selection guide 27*j*). Finally, as illustrated in FIG. 13, the yarn 22*m* is removed from the yarn introduction means 6 and accommodated in the yarn selection guide 27*j*.

The air nozzle 158 of the yarn draw-back device 120 is supplied with compressed are at the same timing of the movements of the yarn selection guide 27*a* and the yarn removing guide 136*a,* and the yarn 22 has been drawn back with a force opposite to the advancing direction of the yarn 22 before the yarn 22 is removed from the yarn introduction means 6. Therefore, the removed yarn 22 is accommodated in the yarn selection guide 27*a* without looseness, and the yarn removing guide 136*a* and the yarn selection guide 27*a* are restored to the inoperative states, thus completing the accommodation of the yarn.

While the yarn introduction means 6 is rotated once after the yarn has been accommodated in the yarn selection guide 27*a,* a yarn selection guide 27*a*–27*j* having a next indicated number is actuated in accordance with the next pattern data order to supply and accommodate the next yarn in a manner similar to the foregoing, and the yarn exchange operation is repetitively executed in a similar procedure until a required number of yarns have been warped.

As described above, the electronically controlled sample warper of the present invention can significantly reduce yarn looseness possibly occurring during yarn exchange as compared with conventional methods, prevent large variations in yarn tension produced when a yarn is removed to improve the quality of warping and significantly improve the speed of yarn exchange, unlike conventional methods which do produce variations in yarn tension during yarn exchange to cause a degraded quality of warping, and eliminate the need for reducing a warping speed even during yarn exchange to largely reduce a warping time, as compared with the case where a conventional yarn exchange mechanism is used.

The warping method of the present invention can realize a significant improvement in warping speed, and exchange yarns with its high warping speed maintained, i.e., without reducing the warping speed, to largely reduce a warping time.

The yarn draw-back device of the present invention can rapidly and efficiently eliminate yarn looseness possibly occurring during yarn exchange.

Obviously, various minor changes and modifications of the present invention are possible in the light of the above teaching. It is therefore to be understood that within the scope of the appended claims the invention may be practiced otherwise than as specifically described.

What is claimed is:

1. An electronically controlled sample warper having a yarn exchange mechanism for automatically exchanging yarns and winding the yarns on a warper drum in accordance with a preset yarn order, said warper comprising:

one or a plurality of yarn introduction means each rotatably mounted to a side surface of said warper drum for winding a yarn on said warper drum;

a plurality of yarn selection guides, arranged in one end portion of a base for supporting said warper drum corresponding to said yarn introduction means, each said yarn selection guide being pivotally moved to protrude to a yarn exchange position when a yarn is exchanged and pivotally moved to retract to a standby position when a yarn is accommodated, wherein yarns are passed between said yarn introduction means and said yarn selection guides; and yarn removing guides arranged in one-to-one correspondence to said plurality of yarn selection guides, wherein when a yarn is removed from said yarn introduction means, the yarn held by said yarn introduction means is caught by one of said yarn removing guides, and said caught yarn is next removed from said yarn introduction means and passed to a corresponding yarn selection guide to minimize yarn looseness produced when it is removed from said yarn introduction means.

2. An electronically controlled sample warper having a yarn exchange mechanism according to claim 1, wherein said yarn removing guides each include an oblique side which is inclined toward the distal end of said yarn introduction means, wherein when a yarn is removed from said yarn introduction means, the yarn held by said yarn introduction means is caught by said yarn removing guide, and thereafter said yarn is slid along said guide oblique side of said yarn removing guide toward the distal end of said yarn introduction means to remove the yarn from said yarn introduction means, thus enabling the yarn to be removed from said yarn introduction means with reduced physical impact to the yarn.

3. An electronically controlled sample warper having a yarn exchange mechanism according to claim 2, wherein each of said yarn removing guide includes a triangular guide portion at the distal end thereof, one side of said triangular guide portion serving as said guide oblique side.

4. An electronically controlled sample warper having a yarn exchange mechanism according to claim 1, further comprising guide rods each for catching a yarn held by said yarn introduction means and guiding said yarn toward a yarn selection guide in corporation with said yarn removing guide, each of said guide rods being offset toward the outside of said warper drum near the distal end of a corresponding yarn removing guide, and arranged obliquely in a direction opposite to a rotating direction of said yarn introduction means.

5. An electronically controlled sample warper having a yarn exchange mechanism according to claim 2, further comprising guide rods each for catching a yarn held by said yarn introduction means and guiding said yarn toward a yarn selection guide in corporation with said yarn removing guide, each of said guide rods being offset toward the outside of said warper drum near the distal end of a corresponding yarn removing guide, and arranged obliquely in a direction opposite to a rotating direction of said yarn introduction means.

6. An electronically controlled sample warper having a yarn exchange mechanism according to claim 3, further comprising guide rods each for catching a yarn held by said yarn introduction means and guiding said yarn toward a yarn selection guide in corporation with said yarn removing guide, each of said guide rods being offset toward the outside of said warper drum near the distal end of a corresponding yarn removing guide, and arranged obliquely in a direction opposite to a rotating direction of said yarn introduction means.

7. An electronically controlled sample warper having a yarn exchange mechanism according to claim 1, further comprising a yarn draw-back device for drawing back a yarn when the yarn is removed from said yarn introduction means to rapidly eliminate yarn looseness.

8. An electronically controlled sample warper having a yarn exchange mechanism according to claim 2, further comprising a yarn draw-back device for drawing back a yarn when the yarn is removed from said yarn introduction means to rapidly eliminate yarn looseness.

9. An electronically controlled sample warper having a yarn exchange mechanism according to claim 3, further comprising a yarn draw-back device for drawing back a yarn when the yarn is removed from said yarn introduction means to rapidly eliminate yarn looseness.

10. An electronically controlled sample warper having a yarn exchange mechanism according to claim 4, further comprising a yarn draw-back device for drawing back a yarn when the yarn is removed from said yarn introduction means to rapidly eliminate yarn looseness.

11. An electronically controlled sample warper having a yarn exchange mechanism according to claim 7, wherein said yarn draw-back device blows compressed air in a direction opposite to a direction in which the yarn is supplied, to draw back the yarn.

12. An electronically controlled sample warper having a yarn exchange mechanism according to claim 8, wherein said yarn draw-back device blows compressed air in a direction opposite to a direction in which the yarn is supplied, to draw back the yarn.

13. An electronically controlled sample warper having a yarn exchange mechanism according to claim 9, wherein said yarn draw-back device blows compressed air in a direction opposite to a direction in which the yarn is supplied, to draw back the yarn.

14. An electronically controlled sample warper having a yarn exchange mechanism according to claim 10, wherein said yarn draw-back device blows compressed air in a direction opposite to a direction in which the yarn is supplied, to draw back the yarn.

15. An electronically controlled sample warper having a yarn exchange mechanism according to claim 1, wherein the amount of yarn looseness produced by a combination of said yarn selection guide and said yarn removing guide, when the yarn is removed from said yarn introduction means, is uniform even with any combination of said yarn selection guide and said yarn removing guide.

16. An electronically controlled sample warper having a yarn exchange mechanism according to claim 2, wherein the amount of yarn looseness produced by a combination of said yarn selection guide and said yarn removing guide, when the yarn is removed from said yarn introduction means, is uniform even with any combination of said yarn selection guide and said yarn removing guide.

17. An electronically controlled sample warper having a yarn exchange mechanism according to claim 3, wherein the amount of yarn looseness produced by a combination of said yarn selection guide and said yarn removing guide, when the yarn is removed from said yarn introduction means, is uniform even with any combination of said yarn selection guide and said yarn removing guide.

18. An electronically controlled sample warper having a yarn exchange mechanism according to claim 4, wherein the amount of yarn looseness produced by a combination of said yarn selection guide and said yarn removing guide, when the yarn is removed from said yarn introduction means, is uniform even with any combination of said yarn selection guide and said yarn removing guide.

19. A fast warping method using an electronically controlled yarn warper having a yarn exchange mechanism according to claim 1 to exchange yarns while a warping yarn speed is maintained.

20. A fast warping method using an electronically controlled yarn warper having a yarn exchange mechanism according to claim 2 to exchange yarns while a warping yarn speed is maintained.

21. A fast warping method using an electronically controlled yarn warper having a yarn exchange mechanism according to claim 3 to exchange yarns while a warping yarn speed is maintained.

22. A fast warping method using an electronically controlled yarn warper having a yarn exchange mechanism according to claim 4 to exchange yarns while a warping yarn speed is maintained.

23. A yarn draw-back device comprising:

a guide tube having an inner space through which a yarn is threaded;

an air blow-in space defined at a distal end portion of said guide tube; and an air introduction means having an air introduction port communicating with said air blow-in space and for blowing off air into said inner space through said blow-in space in a direction opposite to an advancing direction of the yarn, wherein compressed air is introduced from said air introduction port to provide the yarn with a draw-back force in a direction opposite to a supply direction of the yarn so that the yarn can be rapidly drawn back.

* * * * *